United States Patent [19]

Veeder

[11] Patent Number: 4,935,786

[45] Date of Patent: Jun. 19, 1990

[54] METHOD AND APPARATUS FOR DUPLEX PRINTING

[75] Inventor: Nicholas P. Veeder, Weston, Mass.

[73] Assignee: Digital Equipment Corporation, Maynard, Mass.

[21] Appl. No.: 373,119

[22] Filed: Jun. 28, 1989

[51] Int. Cl.[5] ..... G03G 15/00

[52] U.S. Cl. ..... 355/319; 355/24; 355/77; 355/225

[58] Field of Search ..... 355/23, 24, 26, 319, 355/320, 325, 77, 318; 271/186, 225

[56] References Cited

U.S. PATENT DOCUMENTS

| | | | |
|---|---|---|---|
| 4,136,862 | 1/1979 | Kunz et al. | 271/186 |
| 4,300,758 | 11/1981 | Peters, III | 271/225 |
| 4,348,101 | 9/1982 | Schonfeld et al. | 355/319 |
| 4,443,094 | 4/1984 | Ricciardi | 355/319 |
| 4,453,841 | 6/1984 | Bobick et al. | 355/24 X |
| 4,499,500 | 2/1985 | Nagashima | 358/296 |
| 4,609,282 | 9/1986 | Crandall | 355/325 |
| 4,650,176 | 3/1987 | Sugizaki et al. | 271/225 |
| 4,681,428 | 7/1987 | Devoy | 355/325 |
| 4,692,020 | 9/1987 | Tsujihara | 355/319 |

*Primary Examiner*—L. T. Hix
*Assistant Examiner*—Khanh Dang
*Attorney, Agent, or Firm*—Kenyon & Kenyon

[57] ABSTRACT

A duplex printing apparatus has a printing unit for consectively printing images on the first sides of paper sheets and on the second sides of paper sheets. A reversing unit is mounted adjacent to the printing unit for receiving the paper sheets discharged from the printing unit and for consecutively reversing the paper sheets. A duplexing unit is mounted adjacent to the reversing unit and the printing unit, for receiving the reversed paper sheets from the reversing unit and for feeding the reversed sheets back into the printing unit for printing on the second sides of the sheets. A control unit is coupled to the printing unit, the reversing unit, and the duplexing unit. The control unit determines an interleave number that equals the maximum number of sheets with images printed on their first sides that can fit within a duplex feed path, so that each consecutive sheet is spaced a sufficient distance apart to interleave a new sheet therebetween. The control unit is operable so that after the number of sheets equal to the interleave number have the images printed on their first sides, the new sheets are consecutively interleaved therebetween. The new sheets are the printed on their first sides alternately with the reversed sheets that are duplex printed on their second sides.

14 Claims, 11 Drawing Sheets

METHOD AND APPARATUS FOR DUPLEX PRINTING

FIELD OF THE INVENTION

The present invention relates to methods and apparatus for printing and, more particularly, to methods and apparatus for printing images on one and/or both sides of paper or other types of sheet material.

BACKGROUND INFORMATION

With many printing or image recording apparatus, such as laser printers, photocopiers, or facsimile machines, it is often desired to record the printed images of a document on both sides of each sheet of paper (duplex recording). So far, known methods and apparatus have not provided a sufficient solution to the problem of duplex recording.

In accordance with one known method and apparatus for duplex recording, the paper sheets are fed through an image-forming unit and a reversing unit. First, the paper sheets are fed through the image-forming unit where printed images are recorded on one side of each sheet. The sheets of paper are then reversed or flipped over by the reversing unit and fed again through the image-forming unit to record the printed images on the other sides of the sheets. For example, if a sixty page document is to be duplex recorded on thirty sheets of paper, the images are first recorded on one side of each of the thirty sheets of paper in the image-forming unit. While the first sides of the sheets are printed, the sheets are then fed one at a time through the reversing unit and stacked on top of one another in an intermediate paper tray. The stack of reversed sheets are then fed again one at a time through the image-forming unit to record the printed images on the other side of each sheet. This method of duplex recording is often referred to as the stack method, because after the sheets of paper are printed on one side, all of the sheets of the document are stacked on top of one another in an intermediate paper tray, prior to recording the printed images on the other sides of the sheets.

One drawback of the stack method of duplex recording is that when the sheets of paper are temporarily stacked on top of one another in the intermediate paper tray, the sheets then have to be separated from one another and discharged one at a time into the image-forming unit. This paper separating procedure can be particularly troublesome because whenever two or more sheets stick together they are usually then fed through the image-forming unit on top of one another. When this occurs, the pagination of the document becomes incorrect and, if the machine does not catch the error, the document, or at least a portion of it usually has to be reprinted.

Another drawback of the stack method of duplex recording is that different sized paper sheets usually cannot be stacked together in the intermediate paper tray. The intermediate paper tray usually has a pair of guide plates mounted on either side thereof, that are laterally movable relative to the stack to align the stack in the tray, so that the paper sheets can be properly refed through the image-forming unit. If one group of sheets in the stack is wider than another group of sheets, the guide plates will only come into contact with and, therefore, will only align the wider group of sheets. As a result, the narrower paper sheets will likely not be properly aligned when fed through the image-forming unit and thus the printed images will not be properly recorded thereon.

Another problem with the stack method of duplex recording, particularly if duplex recording with a photocopier or facsimile machine, is that if one or more sheets of paper become jammed in a paper feed path, it is difficult to determine which sheet or sheets were jammed and which have to be reprinted. Therefore, when such a jam occurs, frequently, either the entire document has to be reprinted or the operator has to undergo the tedious process of looking through the entire stack of printed sheets to determine which sheets were jammed in order to reprint both sides of those sheets.

Yet another drawback of the stack method of duplex recording and, in particular, when transferring electronically stored information to a hard copy, is that with larger documents, a large amount of computer memory is required to store the printed image information for the second sides of the sheets to be recorded. For example, if a fifty sheet double-sided document (100 pages) is to be printed, all 100 pages of the document are first computed and stored in computer memory. However, if the intermediate paper tray cannot hold all fifty sheets, then the pages for the maximum number of sheets that the intermediate paper tray can hold are computed and stored in computer memory. Then, the fifty odd-numbered sides of the sheets are consecutively printed and the sheets are stacked in the intermediate paper tray. The sheets are then fed again through the image-forming unit, starting with the top sheet on the stack, or, that is, the last sheet to be printed on its odd-numbered side, and the printed image information is then recalled from memory for printing the images on the even-numbered sides of the sheets. Therefore, for larger documents, a large amount of computer memory is required to first store the printed image information for the entire document, or the maximum number of sheets that the intermediate paper tray can hold. The printed image information for 100 pages, for example, is extremely large (one sheet of $8\frac{1}{2}\times 11$ inch paper requires about 8 million bits when imaged at 300 dots per inch). Because it is generally necessary to use the computer memory as efficiently as possible, its use for storing a relatively large amount of printed image information frequently compromises the overall performance and capabilities of the computer system. Likewise, to add additional memory to either the computer or printing apparatus for storing the printed image information for larger documents is often prohibitively expensive.

Another problem of the stack method of duplex recording is that it can be relatively time consuming. For example, in duplex printing a 100 page document, as described above, first the entire 100 pages have to be computed and stored in computer memory before the printing begins. Then, the 50 odd-numbered pages are printed and the sheets are stacked in the intermediate paper tray. Before the even-numbered pages can be printed, the duplexing feed path must be emptied and the last odd-numbered page has to be printed and placed on top of the stack. The last odd-numbered sheet is then fed from the top of the stack as the first even-numbered sheet to be printed, and the even-numbered pages are then printed on the entire stack. The steps of first computing all of the pages of the document, and emptying the duplexing feed path between the odd-numbered page printing mode and even-numbered page printing mode are relatively time consuming and, therefore slow down the overall rate of duplex printing the document.

Another problem with known image-recording apparatus is that frequently the control system of the apparatus cannot distinguish between most emergency and non-emergency stop conditions. A non-emergency stop condition might be, for example, a low toner supply or a low paper supply. Whereas an emergency stop condition is usually a problem that could cause a printing malfunction or error, such as a paper jam in a feed path. Therefore, even when there is a non-emergency condition, some known apparatus will immediately stop in order to treat the problem. As a result, if the apparatus is stopped for a long enough period of time to treat the condition, the paper stopped in the feed path may become curled depending on the shape of the feed path, the type of paper, and the temperature and/or humidity conditions. When the apparatus is started again, the curled sheet of paper will then frequently become jammed in the feed path.

It is an object of the present invention, therefore, to provide an improved method and apparatus for duplex recording that overcomes the problems, drawbacks and disadvantages of known methods and apparatus.

SUMMARY OF THE INVENTION

The present invention is directed to an apparatus for duplex recording images on several sheets of material The apparatus comprises an image recording unit for recording images consecutively on the first sides of the sheets of material and on the second sides of the sheets of material. A reversing unit of the apparatus is mounted adjacent to the image recording unit for receiving the sheets of material discharged from the image recording unit and for consecutively reversing the sheets and/or discharging the sheets therefrom. A duplexing unit of the apparatus is mounted adjacent to the reversing unit for receiving the reversed sheets of material discharged from the reversing unit, and for consecutively feeding the reversed sheets back into the image recording unit for recording images on the second sides of the sheets. The image recording unit, the reversing unit, and the duplexing unit thus define a duplex feed path for carrying the sheets of material for duplex recording.

The apparatus further comprises a control unit coupled to the image recording unit, the reversing unit, and the duplexing unit. The control unit is provided for determining an interleave number that is equal to the maximum number of sheets of material with images recorded on only their first sides, that can fit within the duplex feed path so that each consecutive sheet is spaced a sufficient distance apart to interleave a new sheet therebetween. The control unit controls the image recording unit, the duplexing unit, and the reversing unit so that after a number of sheets spaced apart in the duplex feed path with the images recorded on only their first sides is equal to or less than the interleave number, the new sheets are consecutively interleaved therebetween. The new sheets are then recorded on their first sides alternately with the reversed sheets that are duplex recorded on their second sides.

The present invention is also directed to a method of duplex recording images on several sheets of material in a duplex recording apparatus. The method comprises the steps of determining an interleave number that is equal to the maximum number of sheets of material with images recorded only on their first sides that fits within the duplex feed path, so that each consecutive sheet is spaced a sufficient distance apart to interleave a new sheet therebetween. The images are consecutively recorded on the first sides of a number of sheets equal to or less than the interleave number. The sheets are fed through an image recording unit one after the other and spaced a sufficient distance apart to interleave new sheets therebetween. After a number of sheets equal to or less than the interleave number have the images recorded on their first sides, the new sheets are fed or interleaved therebetween. Thus, the images are recorded on the first sides of the new sheets alternately with the images that are duplex recorded on the second sides of the other sheets.

The present invention is also directed to method for duplex recording images on several sheets of material in a duplex recording apparatus, wherein at least one of the sheets is a different size than at least one of the others. The method comprises the steps of determining an interleave number based on the size of the first sheet to have the images recorded thereon The images are consecutively recorded on the first sides of a number of sheets equal to or less than the interleave number, the sheets being spaced a sufficient distance apart to interleave new sheets therebetween. The interleave number is then changed to a transient interleave number if a different sized sheet than the previous sheet is fed into the duplex feed path. The transient interleave number is based on the length of the new sheet. The next sheet is then recorded on its first side only if the number of sheets in the duplex feed path with images recorded only on their first sides does not exceed the transient interleave number.

In another embodiment of the method of the present invention, a new input media is selected when a different sized sheet is required. If the new sheet is shorter than the previous sheet, the feeding of the new sheet into the duplex feed path is delayed so that the two sheets are spaced a sufficient distance apart so that when the new sheet is reversed, it will not overlap the previous sheet.

In another embodiment of the method and apparatus of the present invention, the sheets are stopped in the duplex feed path in the event of an image processing delay, by first moving each sheet to a different desired stopping location. The stopping locations are selected so that the respective sheet will not develop a curl and/or bend if temporarily stopped, that will cause the sheet later to jam a feed path. The sheets are then moved through the duplex feed path when the recording apparatus recovers from the delay.

In yet another embodiment of the apparatus and method of the present invention, if the interleave number is one integer greater than the number of desired stopping locations, the image information for the first side of the next sheet that will make the number of sheets in the duplex feed path equal to the interleave number is processed. Then, the image information for the next sheet to be duplex recorded is processed prior to recording the images on the first side of the previous sheet. Therefore, if an image processing delay occurs while recording on the first sheet, the images can then be duplex recorded on the second sheet which, in turn, can be discharged from the apparatus. Then, the other sheets recorded on only their first sides are each moved to a respective stopping location until the delay is over.

One advantage of the method and apparatus of the present invention is that by determining the interleave number and then interleaving the sheets into the duplex feed path, the maximum number of sheets that can be handled in the duplex feed path is usually achieved and, therefore, the maximum duplex recording rate of the apparatus is, likewise, substantially achieved. Another advantage of the apparatus and method of the present invention is that while the number of sheets equal to the interleave number can be carried in the duplex feed path, the apparatus can execute a temporary stop request. Pursuant to the temporary stop request, the sheets in the duplex feed path are moved to desired stopping locations that likely will not cause the respective sheets to develop curls and/or bends that might later jam the feed path. Then, when the image delay is over, the apparatus continues to feed the sheets through the duplex feed path.

Other features and advantages of the apparatus and method of the present invention will become apparent in view of the following detailed description and drawings taken in connection therewith.

DETAILED DESCRIPTION OF THE DRAWINGS

Figure 1:
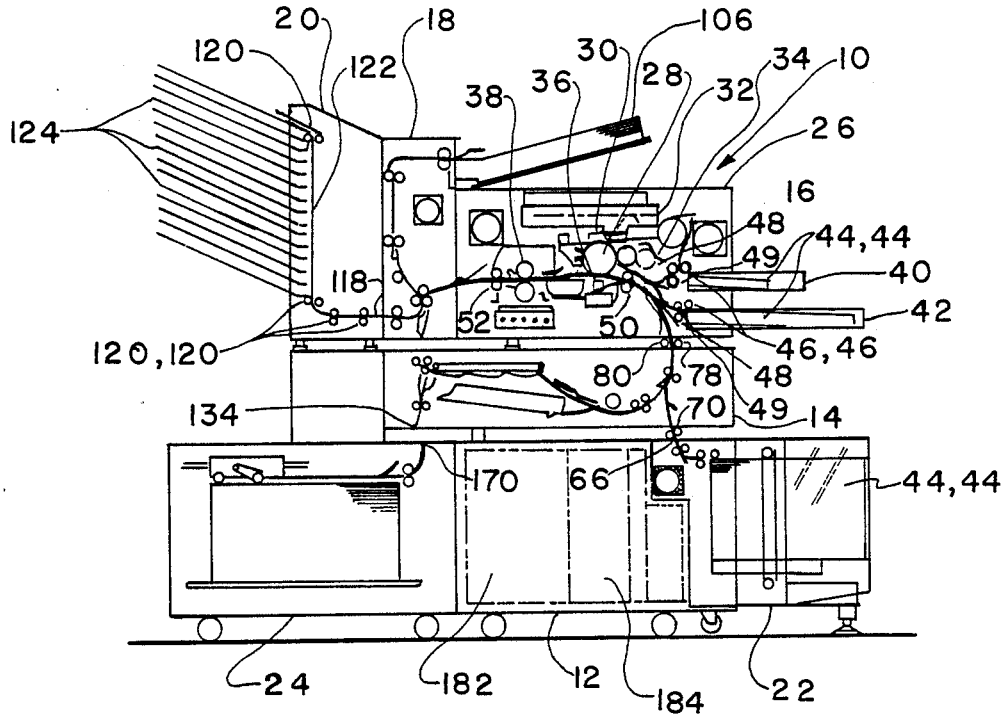
FIG. 1 illustrates schematically a laser printing apparatus embodying the present invention.

In FIG. 1, a laser printing apparatus embodying the present invention is indicated generally by the reference numeral 10. The printing apparatus 10 comprises several modular units including a printer base 12 and a duplexing unit 14 mounted on top thereof. The apparatus 10 further comprises a printing unit 16 mounted on top of the duplexing unit 14, and a reversing unit 18, also mounted on top of the duplexing unit 14 on one side of the printing unit 16. A sorter unit 20 of the apparatus 10 is mounted on one side of the reversing unit 18. The apparatus 10 further comprises a large capacity input tray ("LCIT") 22 mounted on one side of the printer base 12, and a large capacity output tray ("LCOT") 24 mounted on the other side of the printer base 12. Each of the modular units of the apparatus 10 are detachable from one another in a manner known to those skilled in the art. Therefore, the modular units may be selectively used with one another and, likewise, other types of known modular units may be similarly employed with the apparatus 10, such as a paper-folding unit and/or a paper-stapling unit.

The modular units of the printing apparatus 10 function together to simplex print (one-sided printing) or duplex print (two-sided printing) the sheets of paper processed therethrough, generally as follow: The sheets of paper are consecutively fed through the printing unit 16 which records the printed images on the same side of each sheet. While recording the printed images, the printing unit 16 then consecutively discharges the printed sheets of paper into the reversing unit 18 which, in turn, consecutively reverses the sheets of paper and discharges them into either a paper tray, the sorter unit 20 or duplexing unit 14. The sorter unit 20 sorts the individual sheets of paper, whereas the duplexing unit 14 consecutively refeeds the reversed sheets of paper back through printing unit 16 to record the printed images on the other sides of the sheets. The LCIT 22 is provided to hold a relatively large stack of paper which can be fed through the duplexing unit 14 and then into the printing unit 16 to have printed images recorded thereon. The LCOT 24, on the other hand, is provided to receive sheets of paper consecutively discharged through the duplexing unit 14 after the printed images are recorded thereon.

One advantage of the present invention, is that the apparatus 10 may be employed to print in accordance with a method of duplex printing which will hereinafter be referred to as the interleave method. In accordance with the interleave method, the sheets of paper are not stacked in an intermediate paper tray, as would be the case, for example, with the known stack method of duplex printing, but are consecutively fed therethrough one at a time, with a sufficient amount of space between each consecutive sheet in order to feed another sheet therebetween. Therefore, the sheets of paper which each already have the printed images recorded on their first sides, are printed on their second sides alternately with new sheets of paper that are consecutively fed therebetween. As a result, the overall rate of duplex printing can be substantially increased by employing the interleave method of the present invention.

In FIG. 1, the printing unit 16 is shown comprising a housing 26. The housing 26 has mounted therein several image recording components, which are known to those skilled in the art, including a photo-receptor drum 28, a charging unit 30, and a laser light-scanning optical writing unit 32, the latter two both being mounted above the photo-receptor drum 28. The housing 26 further has mounted therein a developing unit 34 mounted in front of the photo-receptor drum 28, an image transfer unit 36 mounted below the photo-receptor drum 28, and an image fusing unit 38 mounted downstream from the photoreceptor drum 28. The printing unit 16 further comprises a first paper cassette 40 and a second paper cassette 42, each mounted on one side thereof. Each paper cassette 40 and 42 holds a stack of several sheets of paper, indicated generally as 44,44. The paper cassettes 40 and 42 can each hold paper sheets of a given set size, and there are various paper sizes for which each paper cassette can accommodate.

The printing unit 16 further has mounted therein a pair of pick-up rollers 46,46. Each pick-up roller 46 is mounted above the first or second paper cassette 40 and 42, respectively, for consecutively removing the sheets of paper 44,44 therefrom. Two reed rollers 48,48 are each mounted adjacent to a respective pick-up roller 46,46, for feeding the sheets of paper discharged from the paper cassettes 40 and 42. Two separator rollers 49,49 are each mounted below a respective feed roller 48. The separator rollers 49,49 are mounted in a manner, known to those skilled in the art, so that they have a tendency to rotate in the same direction as their respective feed rollers 48,48. Therefore, in the event that more than one sheet of paper is pulled from a paper tray by its respective pick-up roller 46, the separator roller 49 prevents the bottom sheet of paper from passing with the top sheet between the feed roller 48 and separator roller 49.

A pair of register rollers 50 is mounted downstream from the pairs of feed rollers 48,48, and separator rollers 49,49, and in front of the photo-receptor drum 28, for feeding the sheets of paper 44,44 therethrough. As can be seen, the paper feed paths from either the first or second paper cassette 40 and 42, respectively, are merged into a single feed path through the register rollers 50. The register rollers 50 must be synchronized with the photo-receptor drum 28 so that the images are properly positioned on the surface of the sheet. If, for example, the photo-receptor drum 28 is rotated ahead or behind the sheet carried through the register rollers 50, only part of the image may be recorded on the sheet. Therefore, if there is a delay in the formation of the image on the photo-receptor drum 28, the register rollers 50 can be delayed so that they remain synchronized with the formation of the image on the drum.

In the operation of the printing unit 16, a sheet of paper is first removed from either the first paper cassette 40 or the second paper cassette 42 by its respective pick-up roller 46. The sheet of paper 44 is then fed through the respective feeding roller 48 and separator roller 49 and, in turn, through the register rollers 50. The register rollers 50 then synchronously feed the sheet of paper 44 between the photo-receptor drum 28 and image transfer unit 36 to record the printed images onto one side of the sheet.

An electrostatic latent image is formed by the laser writing unit 32 on the photo-receptor drum 28. The electrostatic image is then developed into a toner image by the developing unit 34. The toner image is then rotated by the photo-receptor drum 28 until it faces the image transfer unit 36. The image transfer unit 36, in turn, transfers the toner image onto one side of the paper sheet 44, synchronously fed therethrough by the register rollers 50. Preferably, the visible image is formed on the photo-receptor drum 28 by employing an electrophotographic method, known to those skilled in the art, incorporating the following steps: charging-exposure-development-transfer-separation-cleaning-discharging-charging. After the sheet of paper 44 is fed between the photo-receptor drum 28 and the image transfer unit 36, it is then fed through the fusing unit 38, where the image is fused under heat and pressure onto the surface of the sheet. The sheet of paper is then fed through a second pair of feed rollers 52 mounted on the exit side of the fusing unit 38 which, in turn, discharges the sheet of paper into the reversing unit 18.

Figure 2:
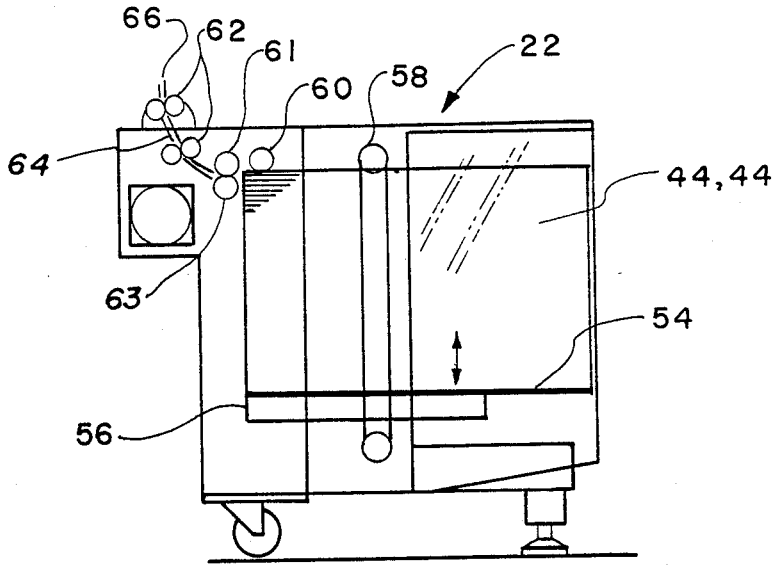
FIG. 2 is a schematic illustration of the large capacity input paper tray ("LCIT") of the apparatus of FIG. 1.

Turning to FIG. 2, the LCIT 22 is shown in further detail, and comprises a paper carrying plate 54 mounted on top of a frame 56. The frame 56 is mounted to a belt and a pulley assembly, indicated generally as 58, which is provided to move the carrying plate 54 either up or down, as indicated by the arrows shown in FIG. 2. The paper carrying plate 54 is adapted to carry a stack of paper sheets 44,44, as shown in FIG. 2. Therefore, the belt and pulley assembly 58 is drivable to move the carrying plate 54 and thus the stack of paper sheets 44,44 either up or down, in order to position vertically the top sheet 44 of the stack. As shown in the drawings, the LCIT 22 is used for carrying a relatively large stack of paper, whereas the first and second paper cassettes 40 and 42, respectively, are used for carrying stacks having fewer sheets.

The LCIT 22 further comprises a first pick-up roller 60 mounted above the stack of sheets 44,44, for consecutively discharging the top sheets from the stack. A feeding roller 61 is mounted downstream and adjacent to the pick-up roller 60, and a separator roller 63 is mounted below the feeding roller 61. The separator roller 63 is mounted, in a manner known to those skilled in the art, so that it has a tendency to rotate in the same direction as the feeding roller 61. Therefore, if the pick-up roller 60 pulls more than one sheet of paper 44 from the stack, the separator roller 63 prevents the bottom sheet from passing through the rollers. Two pairs of feeding rollers 62,62, are each successively mounted downstream from the feeding roller 61 and separator roller 63, along a paper feed path 64. A discharge port 66 is located on the other end of the paper feed path 64 in the top of the LCIT 22. Therefore, in the operation of the LCIT 22, the top sheets of paper 44,44 are consecutively pulled from the stack by the pick-up roller 60 and are each fed, in turn, through the feeding roller 61 and separator roller 63. The sheets are then consecutively fed through the feeding rollers 62,62 and discharged through the discharge port 66 into the duplexing unit 14. While the sheets of paper 44,44 are successively discharged from the top of the stack by the pick-up roller 60, the belt and pulley assembly 58 is operated to drive the paper carrying plate 54 upwardly so that each successive top sheet of paper 44,44 maintains contact with the pick-up roller 60.

Figure 3:
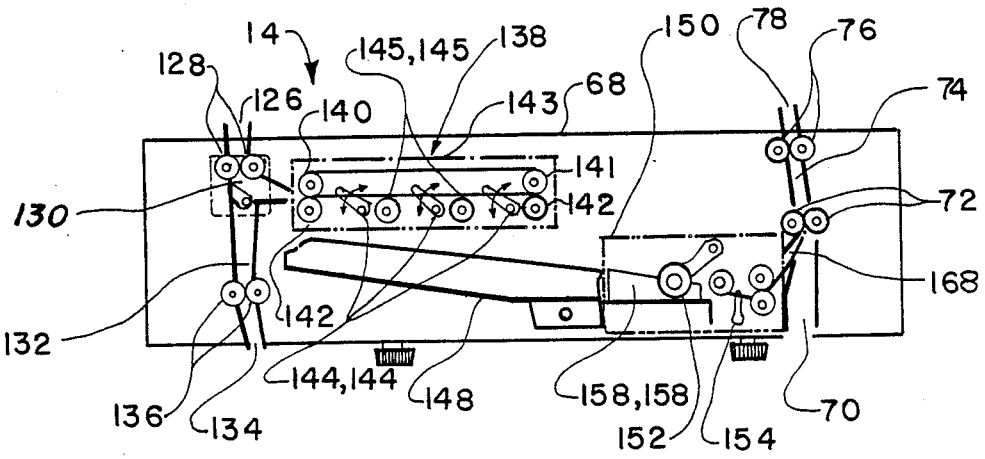
FIG. 3 is a schematic illustration of the duplexing unit of the apparatus of FIG. 1.

Turning to FIG. 3, the duplexing unit 14 is shown in further detail, and comprises a housing 68 having formed in the bottom thereof a paper entrance port 70. As shown in FIG. 1, the paper entrance port 70 is located adjacent to the paper discharge port 66 of the LCIT 22, so that the paper sheets can be fed therethrough. The duplexing unit 14 further comprises a pair of intermediate feed rollers 72 located above the paper entrance port 70 along a paper-feed path 74. A pair of upper discharge rollers 76 are located above the intermediate feed rollers 72 on the paper feed path 74, and immediately below a paper discharge port 78 located in the top of the housing 68. Therefore, the paper sheets 44,44 fed into the paper entrance port 70 are carried upwardly through the intermediate feed rollers 72 and upper discharge rollers 76, and are discharged through the paper discharge port 78 into the printing unit 16.

As shown in FIG. 1, the printing unit 16 has a paper entrance port 80 located in the bottom of the housing 26, immediately above the paper discharge port 78 of the duplexing unit 14. The paper entrance port 80 is located immediately below the register rollers 50 for feeding the sheets of paper 44,44 from the duplexing unit 14 therethrough. Therefore, the paper sheets 44,44 stacked in the LCIT 22, are fed through the duplexing unit 14 and, in turn, through the printing unit 16 to have printed images recorded thereon in the same manner as the paper sheets stacked in the first and second paper cassettes 40 and 42, respectively.

Figure 4:
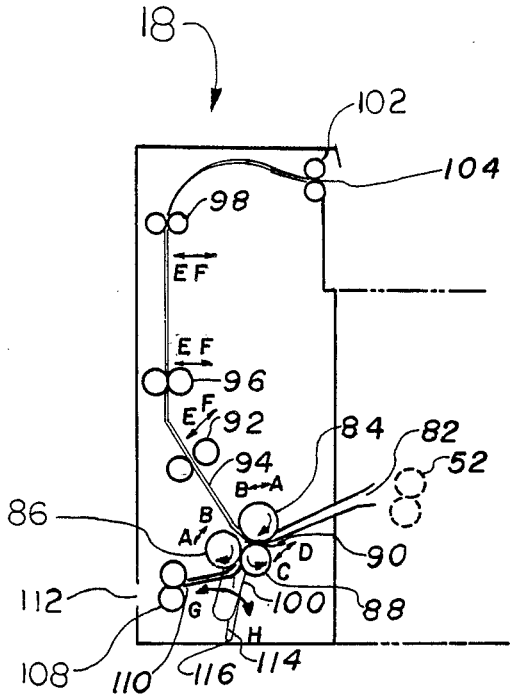
FIG. 4 is a schematic illustration of the reversing unit of the apparatus of FIG. 1.

Turning to FIG. 4, the reversing unit 18 is shown in further detail. The reversing unit 18 is used to reverse or, that is, flip-over the sheets of paper 44,44 that are discharged from the printing unit 16. The reversing unit 18 comprises a paper entrance port 82 located in the side thereof adjacent to the printing unit 16, and a first switching roller 84 mounted in front of the paper entrance port 82. A second switching roller 86 is mounted adjacent to the first switching roller 84, and a driving roller 88 is mounted in contact with both the first switching roller 84 and second switching roller 86. As indicated by the arrows shown in FIG. 4, the first and second switching rollers 84 and 86, respectively, both rotate in a clockwise direction, whereas the driving roller 88 rotates in a counterclockwise direction.

The first and second switching rollers 84 and 86 are of a type known to those skilled in the art, and each define a plurality of axially spaced roller sections mounted on a shaft with gaps defined therebetween (not shown). The driving roller 88 similarly comprises a plurality of axially spaced roller sections mounted on a shaft with gaps defined therebetween (not shown). As indicated by the dash-dot lines and arrows shown in FIG. 4, the first and second switching rollers 84 and 86, respectively, are each movable along an arc relative to each other in the directions A and B. Therefore, when the first and second switching rollers 84 and 86, respectively, are each moved in the direction B, they are moved toward one another and when they are each moved in the direction A they are further spaced apart from one another. The adjacent roller sections (not shown) of the first and second switching rollers 84 and 86 are axially spaced relative to one another so that when the rollers are both moved in the direction B, the roller sections do not contact each other, but are moved into the adjacent gaps defined between the roller sections of the other roller.

The reversing unit 18 further comprises a switching guide 90 which is mounted between the first switching roller 84 and the driving roller 88 so that it fits between several of the axially spaced roller sections thereof. The switching guide 90 is moveable relative to the rollers in the directions C and D, as indicated by the dash-dot line and arrows shown in FIG. 4. The reversing unit 18 also comprises a pair of return rollers 92 located above the first and second switching rollers 84 and 86, respectively, on a paper feed path 94. The return rollers 92 are moveable relative to one another in the directions E and F, as indicated by the dash-dot lines and arrows shown in FIG. 4. The return rollers 92 are coupled to the switching guide 90 so that when the switching guide 90 is moved in the direction C, the return rollers are moved apart from one another in the direction F, and vice versa.

The reversing unit 18 further comprises a first pair of feed rollers 96 and a second pair of feed rollers 98, each located successively above the return rollers 92, on the paper feed path 94. The individual rollers of each of the first and second pairs of feed rollers 96 and 98, respectively, are also moveable relative to one another in the directions E and F, as indicated by the dash-dot lines and arrows shown in FIG. 4. Therefore, the return rollers 92 and the first and second feed rollers 96 and 98, respectively, can each be moved in the direction E against one another in order to carry the sheets of paper 44,44 therethrough. Likewise, each of the pairs of rollers 92, 96 and 98 can be moved in the direction F, apart from one another, in order to permit the sheets of paper 44,44 to slide therethrough. The reversing unit 18 further comprises a pair of discharge rollers 102, which are mounted immediately in front of a paper discharge port 104 located on the side thereof adjacent to the printing unit 16. As shown in FIG. 1, a paper tray 106 of the apparatus 10 is mounted to the reversing unit 18 immediately below the discharge port 104, for receiving and stacking the paper sheets 44,44 discharged therefrom.

The reversing unit 18 further comprises a pair of sorter discharge rollers 108 mounted downstream from the switching rollers 84 and 86, and the driving roller 88, on a sorter feed path 110. The sorter discharge rollers 108 are located immediately in front of a sorter discharge port 112, which is located on the side of the reversing unit 18 adjacent to the sorter unit 20. A paper exit guide 100 is pivotally mounted immediately below the driving roller 88 and second switching roller 86, the free end of which fits between several of the axially spaced roller sections of the driving roller 88 and second switching roller 86. The paper exit guide 100 is moveable in the directions G and H, as indicated by the dash-dot lines and arrows shown in FIG. 4. A lower feed path 114 is located immediately below the driving roller 88, and a lower discharge port 116 is located on the end of the lower feed path 114 in the bottom of the reversing unit 18. The paper sheets 44,44 reversed through the reversing unit 18 can be discharged through the lower discharge port 116 into the duplexing unit 14. The paper exit guide 100 is moveable in either the directions G or H to control the feed direction of the paper sheets 44,44 carried between the driving roller 88 and second switching roller 86. The paper exit guide 100, therefore, directs the sheets either into the sorter feed path 110 (direction H) or into the lower feed path 114 (direction G).

In operating the reversing unit 18, it can be selectively controlled to reverse and feed the paper sheets 44,44 either into the paper tray 106, the sorter unit 20, or the duplexing unit 14. If the paper sheets 44,44 are to be fed to the paper tray 106, the first and second switching rollers 84 and 86, respectively, are each moved in the direction A apart from one another. The switching guide 90 is then moved in the direction C in order to direct the paper sheets upwardly into the paper feed path 94, and the return rollers 92 are, in turn, moved in the direction F apart from one another. The two pairs of feed rollers 96 and 98 are then each moved in the direction E so that the rollers in each pair press against one another. Therefore, the paper sheets 44,44 carried between the driving roller 88 and first switching roller 84 first pass through the return rollers 92. The paper sheets 44,44 are then carried by the feed rollers 96 and 98 upwardly into the discharge rollers 102 and, in turn, are passed through the discharge port 104 into the upper paper tray 106.

If the paper sheets 44,44 are to be reversed and discharged into the sorter unit 20, the first and second switching rollers 84 and 86, respectively, are again each moved in the direction A so that they are spaced apart from one another. The switching guide 90 is also moved in the direction C, in order to direct the paper sheets upwardly into the paper feed path 94, and the return rollers 92 are, in turn, moved in the direction F apart from one another. The feeding rollers 96 and 98 are each moved in the direction E so that the rollers are pressed against one another. Accordingly, the switching guide 90 directs each sheet 44 between the driving roller 88 and first switching roller 84, and into the feed path 94, where the sheet is then carried upwardly through the feeding rollers 96. However, after the trailing edge of the paper sheet passes through the first switching roller 84 and driving roller 88, the feeding rollers 96 and 98 are then each moved in the direction F so that the rollers are moved apart from one another. The return rollers 92 are then moved in the direction E so that they press against one another, and the switching guide 90 is, in turn, moved in the direction D. The return rollers 92 are then rotated to drive the sheet of paper downwardly toward the bottom of the reversing unit, and thus reverse the sheet of paper. The paper exit guide 100 is then moved in the direction H to direct the sheet of paper toward the sorter unit 20. The reversed sheet of paper 44, therefore, is fed between the second switching roller 86 and driving roller 88, where the sheet is guided by the paper exit guide 100 into the sorter feed path 110. The sheet of paper 44 is then fed by the sorter discharge rollers 108 through the sorter discharge port 112 and, in turn, into the sorter unit 20.

If the sheets of paper 44,44 are to be reversed in the reversing unit 18 and discharged into the duplexing unit 14, each sheet is first fed into the feed path 94, and then reversed through the second switching roller 86 and driving roller 88, as described above. However, the paper discharge guide 100 is moved in the direction G in order to guide the sheets of paper into the lower feed path 114. The sheets of paper 44,44 are then each discharged through the lower discharge port 116 into the duplexing unit 14.

One advantage of the method and apparatus of the present invention is that the reversing unit 18 is controlled to consecutively reverse and discharge the sheets at an increased speed over known reversing apparatus. In FIG. 10, the first and second switching rollers 84 and 86, respectively, the driving roller 88, and the switching guide 90 are shown schematically in separate stages of reversing paper sheets **44*f* through 44*g* through the reversing unit 18. Moving from left to right in FIG. 10, the first sheet of paper 44*f* is shown being fed between the first switching roller 84 and driving roller 88 into the feed path 94. Then, when the trailing edge of the sheet 44*f* exits the first switching roller 84 and driving roller 88, the leading edge of the second sheet of paper 44*g* is then fed therethrough. While the second sheet 44*g* is fed through the switching roller 84 and driving roller 88, the first sheet of paper 44*f* is then reversed and fed downwardly through the second switching roller 86 and driving roller 88. Then, when the second sheet of paper 44*g* is fed into the feed path 94, the first sheet of paper 44*f* is discharged downwardly into the duplexing unit 14, and the leading edge of the third sheet of paper 44*h* is fed into the first switching roller 84 and driving roller 88. When the trailing edge of the third sheet of paper 44*h* is fed into the feed path 94, the trailing edge of the second sheet of paper 44*g* is then discharged downwardly through the driving roller 88 and second switching roller 86**. As can be seen, all three sheets of paper are consecutively fed through the reversing unit so that they are each located in separate stages of the reversing unit at the same point in time. Therefore, unlike many known duplex printing apparatus wherein a subsequent sheet of paper is not fed into the reversing rollers until the previous sheet of paper exits the reversing rollers, the method and apparatus of the present invention ordinarily reverses the sheets at a faster rate. As a result, the overall rate of duplex printing is usually increased.

Turning again to FIG. 1, the sorter unit 20 is shown mounted adjacent to the reversing unit 18, and is employed for collating the sheets of paper 44,44 fed therethrough. The sorter unit 20 comprises a paper entrance port 118 located on the side thereof adjacent to the sorter discharge port 112 of the reversing unit 18. The sorter unit 20 further comprises several feed rollers 120,120 rotatably mounted along a paper feed path 122. A sorter tray 124, of a type known in the art, comprising a number of different levels for holding one or more sheets of paper, is mounted on one side of the sorter unit for receiving the sheets of paper carried along the paper feed path 122. As shown in FIG. 1, the paper feed path 122 extends along one side of the sorter tray 124. A directional switching guide (not shown), of a type known in the art, is mounted inside the sorter unit adjacent to the sorter tray 124 for directing the individual sheets of paper 44,44 into the different levels of the sorter tray 124. The sheets of paper 44,44, therefore, are collated in sequence in the levels of the tray 124.

The duplexing unit 14 is employed for feeding sheets of paper 44,44 either into the printing unit 16 or the LCOT 24. As shown in FIG. 3, the duplexing unit 14 further comprises a paper entrance port 126 located in the top of the housing 68 adjacent to the lower discharge port 114 of the reversing unit 18. A pair of inlet feed rollers 128 are located immediately below the paper entrance port 126 for feeding the sheets of paper 44,44 therethrough. A switching finger 130 is pivotally mounted below the inlet feed rollers 128, and is moveable, as indicated by the arrows shown in FIG. 3, for directing the sheets of paper 44,44 either to, or away from a paper feed path 132 located immediately below it. The duplexing unit 14 further comprises a lower discharge port 134, located in the bottom of the housing 68 on the side adjacent to the LCOT 24. A pair of lower discharge rollers 136 are mounted in front of the lower discharge port 134, along the paper feed path 132, for feeding the sheets of paper 44,44 through the discharge port. In the operation of the duplexing unit 14, sheets of paper are fed from the reversing unit 18 to the LCOT 24 by moving the switching finger 130 so that the sheets of paper are directed into the paper feed path 132. The sheets of paper are then fed by the lower discharge rollers 136, through the lower discharge port 134, and into the LCOT 24.

The duplexing unit 14 further comprises a releasing gate, indicated generally as 138, which comprises a first set of pulleys 140 (only one shown) located on the entrance side of the releasing gate and a second set of pulleys 141 (only one shown) located on the exit side of the releasing gate. Several laterally spaced belts 143 (only one shown) are mounted over the first set of pulleys and second set of pulleys, 140 and 141, respectively. The releasing gate 138 further comprises two sets of feeding rollers 142,142 each mounted below one of the first and second sets of pulleys 140 and 141, respectively. The releasing gate 138 further comprises three switching fingers 144,144, which are each pivotally moveable as indicated by the arrows shown in FIG. 3, and two intermediate feed rollers 145,145 located respectively between the switching fingers 144,144. The sheets of paper 44,44 are directed into the releasing gate 138 by the switching finger 130 between the belts 143 and pulleys 142. The duplexing unit 14 also comprises an intermediate paper tray 148 mounted below the releasing gate 138, to receive the sheets of paper 44,44 fed therethrough.

In operating the duplexing unit 14 to duplex print the sheets of paper 44,44, the sheets are continuously fed one after the other and printed on one side in the printing unit 16 and reversed in the reversing unit 18. Each sheet is then consecutively fed through the entrance port 126, and inlet feed rollers 128, where it then directed by the switching finger 130 into the releasing gate 138. The belts 43 and feed rollers 142 feed each sheet of paper 44 therethrough, and depending upon the length of the sheet, each sheet is directed by one of the three switching fingers 142,142 into the intermediate paper tray 148. For example, a longer sheet of paper 44 would normally be directed by the switching finger 142 located adjacent to the entrance feed rollers 140. A shorter sheet of paper, on the other hand, would be directed by either the middle or the last switching finger 144 onto the intermediate paper tray 148.

Figure 5:
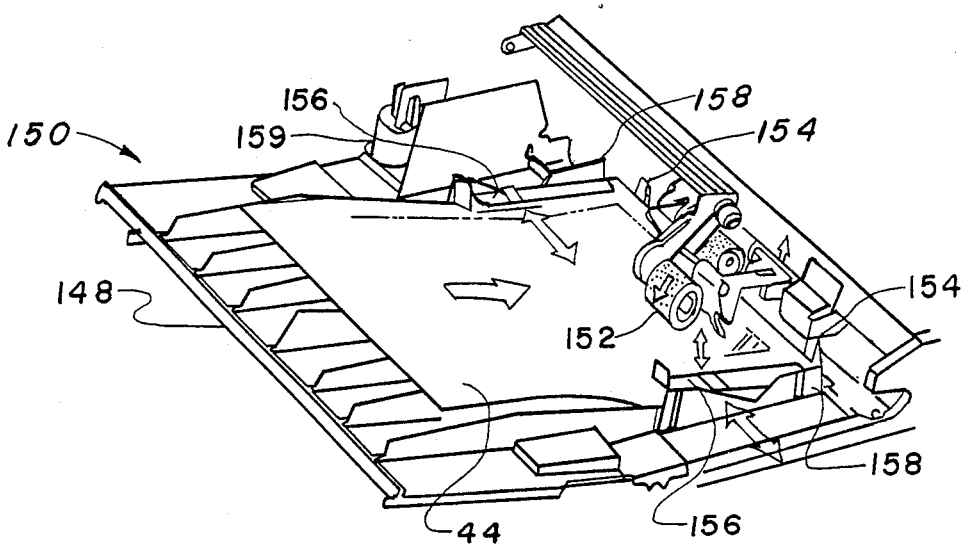
FIG. 5 is a top perspective illustration of the jogger unit mounted in the duplexing unit of FIG. 3.
Figure 6:
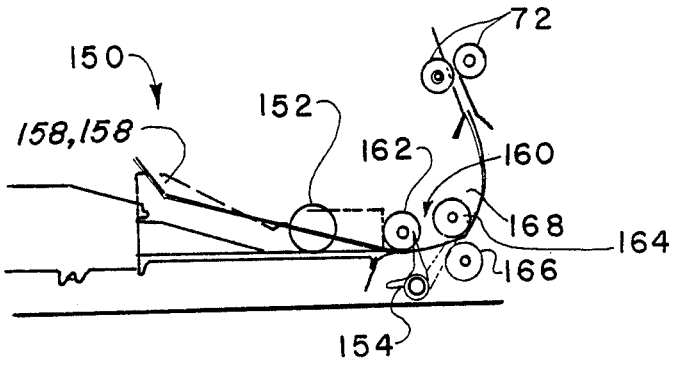
FIG. 6 a cross-sectional schematic illustration of the jogger unit of FIG. 5.

The duplexing unit 14 further comprises a jogger unit, indicated generally as 150, and shown in further detail in FIGS. 5 and 6. The jogger unit 150 is mounted on the lower end of the intermediate paper tray 148, and is provided for aligning the sheets of paper fed therethrough prior to feeding each sheet back through the printing unit 16. The jogger unit 150 comprises a jogger feed roller 152, which is pivotally mounted against the top surface of each sheet of paper 44 fed into the jogger unit. A pair of stopping members 154,154 are located on the exit side of the jogger unit and are provided to stop the leading edge of each sheet of paper 44 fed into the jogger unit, as shown in FIG. 5. A pair of top surface guides 156,156 are each located on either side of the jogger unit and are biased downwardly against each sheet of paper 44 fed therein. The jogger unit 150 further comprises two jogger partitions 158,158, which are each located on either side thereof, and are moveable by a jogger motor 159 in a direction lateral to the sides of the paper sheet 44 fed into the jogger unit to align the sheet, as indicated by the arrows shown in FIG. 5.

In the operation of the jogger unit 150, the sheets of paper 44,44 are fed one at a time from the intermediate paper tray 148 beneath the top surface guides 156,156, which press the sheet against the bottom surface of the jogger unit. Each sheet of paper is then positioned between the two jogger partitions 158,158, and the jogger feed roller 152 is rotated in the direction of the arrow shown in FIG. 5, in order to ensure that the leading edge of the sheet is placed against the stopping members 154,154. The jogger partitions 158,158 are then driven laterally by the jogger motor 159 in the directions of the arrows shown in FIG. 5, to align the sheet of paper 44 with respect to the center line of the jogger unit, prior to feeding the sheet back through the printing unit 16.

The duplexing unit 14 further comprises a refeeding unit, indicated generally as 160, located on the paper exit side of the jogger unit 150. A pick-up roller 162 is mounted adjacent to the stopping members 154,154, and a feeding roller 164 is mounted downstream from the pick-up roller 162. A separator roller 166 is mounted below the feeding roller 164, and a feed path 168 extends from the feeding roller 164 and separator roller 166 to the pair of intermediate feed rollers 762, for carrying the sheets of paper 44,44 therethrough.

In operating the duplexing unit 14 to return the sheets of paper through the printing unit 16 for duplex printing, the stopping members 154,154 are controlled so that when each sheet is aligned in the jogger unit 150, the stopping members are then moved downwardly to permit the sheet to be discharged therefrom. The pick-up roller 162 is then rotated to discharge the sheet 44 from the jogger unit to the feeding roller 164 and the separator roller 166. The sheets of paper 44,44 are thus fed one at a time into the feed path 168 and, in turn, through the intermediate feed rollers 72. Each sheet of paper 44 is then fed through the paper feed path 74, and upper discharge rollers 76 and, in turn, through the paper discharge port 78 into the printing unit 16. In the printing unit 16, the sheets of paper are fed through in the same manner as described above in order to duplex print the images on the blank side of each sheet.

Figure 7:
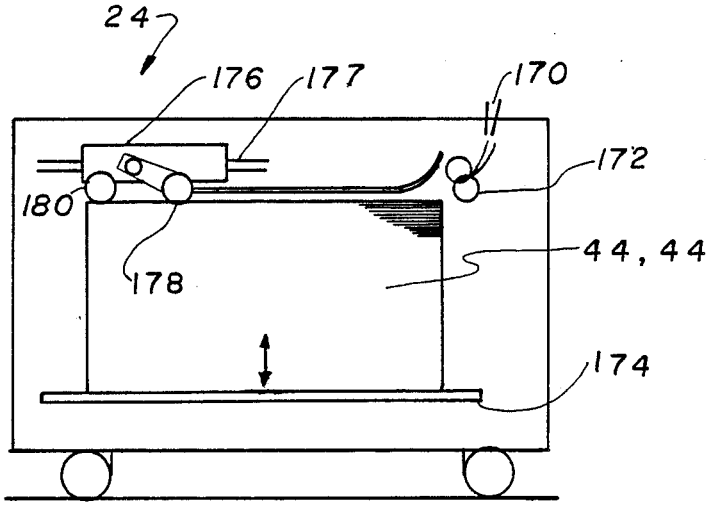
FIG. 7 is a schematic illustration of a large capacity paper output tray ("LCOT") of the apparatus of FIG. 1.

Turning to FIG. 7, the LCOT 24 is shown in further detail, and comprises a paper entrance port 170, located in the top thereof adjacent to the lower discharge port 134 of the duplexing unit 14, as shown in FIG. 1. The LCOT 24 further comprises a pair of job separation feed rollers 172, which are located below the paper entrance port 170, for carrying the sheets of paper therethrough. The LCOT 24 further comprises a paper carrying plate 174 that is provided for carrying a large stack of paper sheets 44,44. The paper carrying plate 174 is vertically moveable, as indicated by the arrows shown in FIG. 7, in a manner known to those skilled in the art, in order to maintain the vertical position of the top sheet of the stack. The LCOT 24 further comprises a paper stacking unit 176 mounted on a shaft 177 above the paper carrying plate 174. The paper stacking unit 176 comprises a first stacking roller 178 pivotally mounted on one side thereof, and biased against the top sheet 44 of the stack, and a second stacking roller 180 mounted on the bottom thereof. The first and second stacking rollers 178 and 180, respectively, are located near the side of the LCOT opposite the feed rollers 172, and are provided to position the leading edge of the top sheet 44 of the stack. Therefore, in the operation of the LCOT 24, the paper sheets 44,44 are fed one at a time through the paper entrance part 170 and job separation feed rollers 172, and onto the paper carrying plate 174. The paper carrying plate 174 is vertically adjusted so that the top sheet of paper 44 maintains contact with the first and second job stacking rollers 178 and 180, respectively. The first and second job stacking rollers, in turn, stop the leading edge of the top sheet 44 of the stack near the end of the paper carrying plate 174, so that each sheet is uniformly aligned on top of one another, as shown in FIG. 7.

Turning again to FIG. 1, the printing apparatus 10 further comprises a system controller unit 182 and a print engine controller 184, which are both mounted inside the printer base 12, and are provided to control electrically the various components of the apparatus 10. The apparatus 10 further comprises several component control units (not shown), known in the art, which are electrically coupled to the print engine controller 184. Each component control unit is mounted in a respective modular unit of the apparatus for communicating with the print engine controller 184, in order to control electrically the respective modular unit. Therefore, the system controller 182 communicates with the print engine controller 184 which, in turn, communicates with the respective component control units to operate the apparatus 10. The component control units are respectively electrically coupled with each of the following modular units: the printing unit 16, the reversing unit 18, the duplexing unit 14, the LCIT 22, the sorter unit 20, and the LCOT 24.

In employing the interleave method of the present invention, an interleave number ("Interleave No.") is determined that is the maximum number of paper sheets that can be fed through the printing unit 16 to have the images printed on a first side thereof, before the other sheets are fed or interleaved therebetween. The Interleave No. is determined depending upon the overall length of the feed path for the paper sheets 44,44 for duplex printing (the "duplex feed path"), the length of each paper sheet, and the distance to be maintained between each consecutive sheet. The Interleave No. for the printing apparatus 10 is determined preferably in accordance with the following equation:

$$2(N-1)p+(2N-1)\geqq L-D$$

wherein:

N is the Interleave No.;

p is the length of the paper sheet in the direction of the duplex feed path;

g is the minimum gap that can be maintained between consecutive sheets;

L is the length of the duplex feed path; and

D is the minimum distance that can be maintained between the leading edge of a second sheet of paper approaching the intermediate paper tray 148 and the leading edge of a first sheet of paper located in the intermediate paper tray, before the first sheet of paper should be discharged from the intermediate paper tray so that the two sheets do not overlap to the extent that they will be confused by the printing apparatus.

The length of the duplex feed path (L) is measured from the leading edge of a sheet of paper located in the feed path 94 immediately before it is discharged downwardly through the second switching roller 86 and driving roller 88 (that leading edge was the trailing edge before it exited the first switching roller 84 and driving roller 88), through the duplex feed path and back to that leading edge. The minimum gap (g) between consecutive sheets is ordinarily about 60 millimeters. However, if, for example, different sized sheets are consecutively printed, the distance maintained between the sheets may have to be adjusted and, therefore, the Interleave No. may change, as will be described further below.

Figure 8:
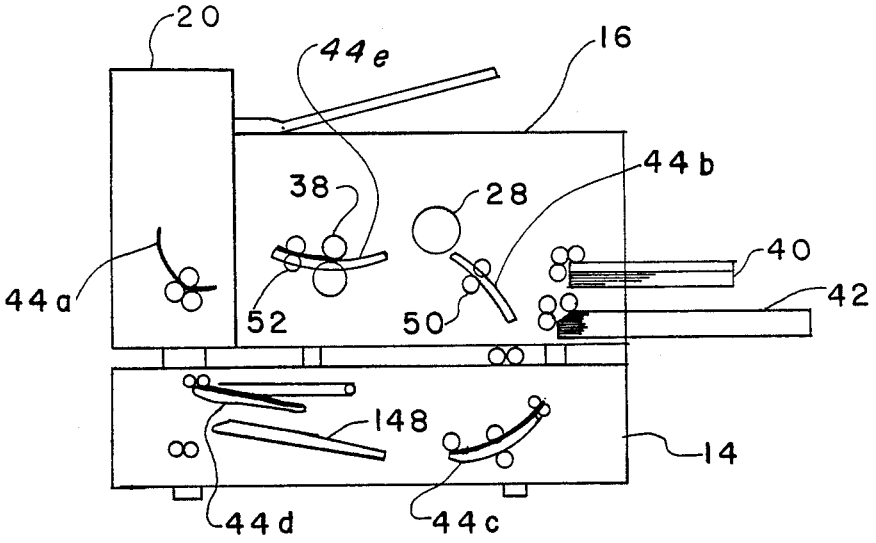
FIG. 8 is a schematic illustration of part of the apparatus of FIG. 1, illustrating in part the interleave method of duplex recording of the present invention.

The interleave method of the present invention is illustrated in part in FIG. 8, where five sheets of paper **44*a* through 44*e*, are each shown in various stages of duplex printing in a schematic illustration of part of the printing apparatus 10. The sheet 44*a* was the first sheet fed into the apparatus 10 and is shown with images recorded on both sides thereof. The other four sheets of paper 44*b* through 44*e* each have the printed images on only one side thereof. As can be seen, the first three sheets to be consecutively fed into the apparatus, 44*a*, 44*b* and 44*c*, are spaced a sufficient distance apart so that the other sheets can be alternatively fed or interleaved therebetween. Therefore, the sheet 44*e*, for example, was fed into the printing unit 16 between the sheets 44*a* and 44*b***, after the latter two sheets already had the printed images recorded on their first sides.

In accordance with one example of the interleave method of the present invention, the duplex printing of a document having 12 pages of printed image information to be printed on 6 sheets of paper will be hereinafter described. In this case, the Interleave No. is four (4) which, as mentioned above, depends on the length of the duplexing path, the length of each sheet of paper, and the distance maintained between the consecutive sheets. The pages of the document are printed so that the even-numbered pages are printed on the first side of each sheet, and the odd-numbered pages are printed on the second side of each sheet. Therefore, the printing operation begins with p. 2, and the pages of the document are then printed in the following order:

| | | | | |
|---|---|---|---|---|
| p. 2 | p. 4 | p. 6 | p. 8 | (p. 1) |
| p. 10 | (p. 3) | p. 12 | (p. 5) | |
| (p. 7) | (p. 9) | (p. 11) | | |

The underlining indicates that those pages of the document are interleaved, or, that is alternately printed on the first and second sides of the respective paper sheets. The parenthesis indicate that that page of the document is printed on the second side of its sheet.

As can be seen, initially, the image information for the first four even-numbered pages of the document (pp. 2, 4, 6, and 8) (which equals the Interleave No.) are consecutively printed on the first sides of the first four paper sheets. Then, when the first paper sheet 44 has been reversed and fed back to the register rollers 50 of the printing unit 16, the first odd-numbered page of the document (p. 1) is duplex printed on the second side of that sheet. Thereafter, the images are printed alternately on the first and second sides of the consecutive paper sheets. After the images are printed on at least the first sides of all of the sheets of the document, then, the remaining sheets, in which the second sides are blank (the number of which equals the Interleave No.), are consecutively duplex printed on their second sides.

One advantage of the interleave method of the present invention is that the paper sheets do not have to be temporarily stacked in an intermediate paper tray in order to duplex record each sheet, as would be the case with the known stack method of duplex recording. Instead, the paper sheets are consecutively fed one after the other through the printing unit and, after a number of sheets (which is equal to or less than the Interleave No.) have the images recorded on their first sides, the other sheets are fed or interleaved therebetween so that the first and second sides of the sheets are then alternately printed. One advantage of the present invention is that because the paper sheets are not stacked, but are continuously fed one after the other through the apparatus, the sheets first fed through the apparatus are normally printed on both sides faster than would be the case under the known stack method of duplex printing. As a result, less memory space is usually required to store the printed image information for a document.

Figure 10A:
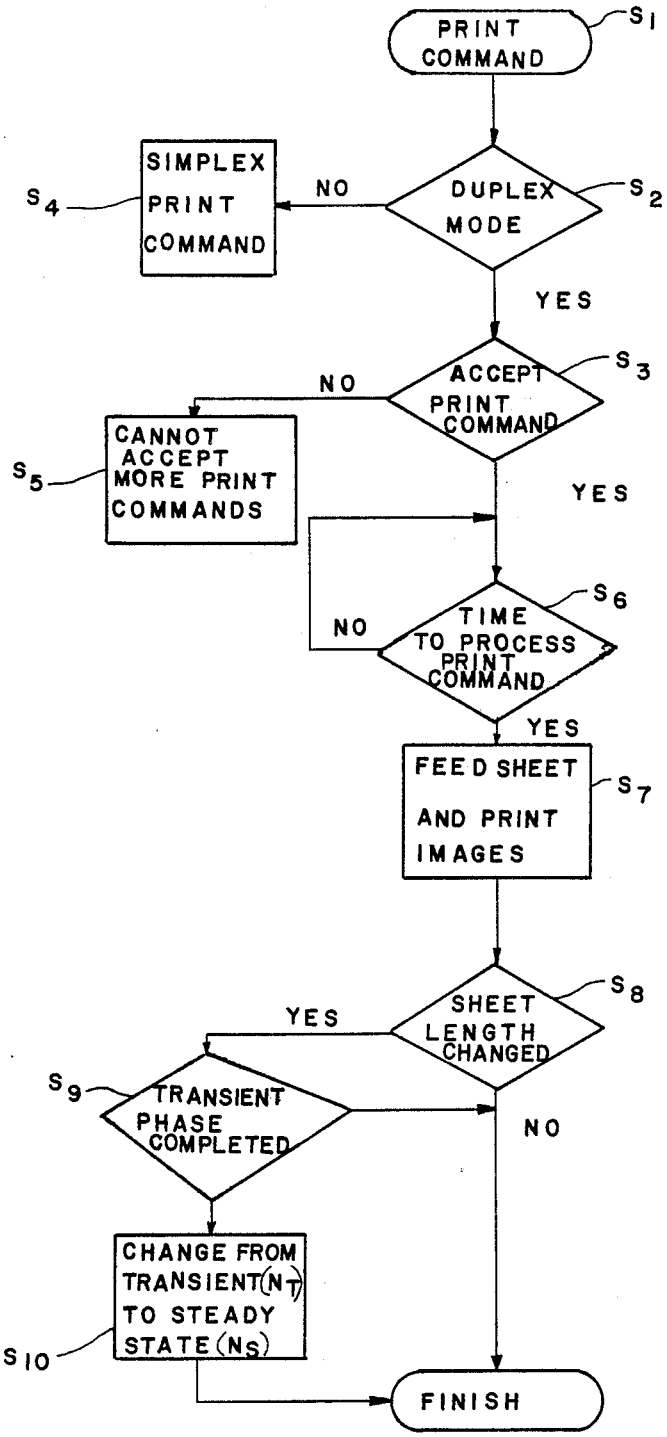
FIG. 10A is a flow chart illustrating conceptually the procedures of the print engine controller of the apparatus of FIG. 1 for executing a print command.
Figure 10B:
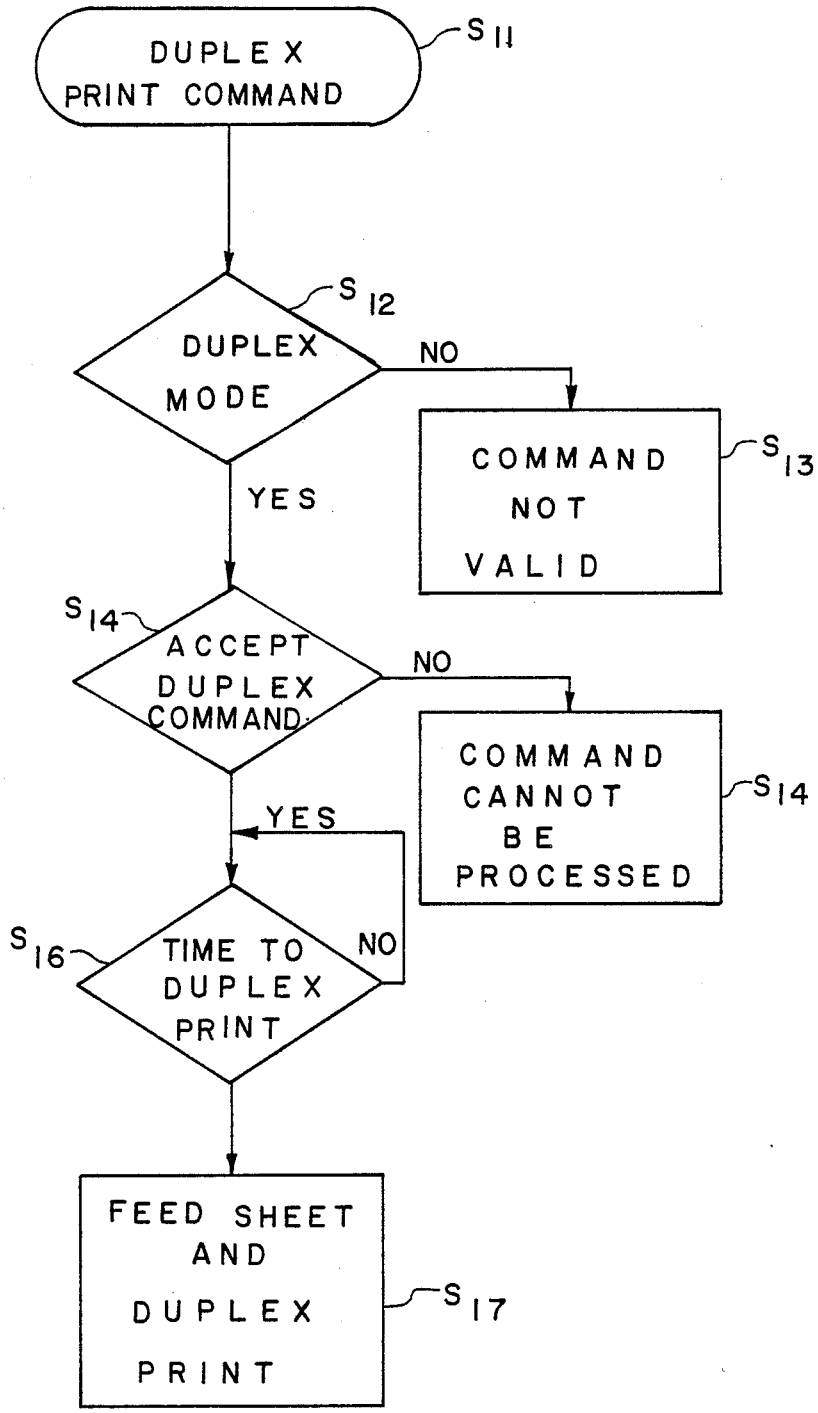
FIG. 10B is a flow chart illustrating conceptually the procedures of the print engine controller of the apparatus of FIG. 1 for executing a duplex print command.

In FIGS. 10A and 10B, two flow charts are illustrated that describe conceptually the procedures for operating the print engine controller 184 in response to commands from the system controller 182, in accordance with the interleave method of the present invention. The labels $S_1$ through $S_n$ indicate the different steps of the procedures. FIG. 10A describes conceptually the procedures for implementing a print command to print the images on the first side of a sheet of paper. FIG. 10B, on the other hand, describes conceptually the procedures for implementing a duplex print command to print the images on the second side of a sheet of paper.

In FIG. 10A, the first box $S_1$ indicates that the system controller 182 generates a print command to the print engine controller 184. If the print engine controller 184 is not set by the system controller 182 in the duplex mode (No), as indicated at $S_2$, then the procedures move to $S_4$ and the print engine controller 184 operates the apparatus 10 to print the page in the simplex mode. If the print engine controller 184 is set in the duplex mode, it then determines whether the apparatus can accept the print command, as indicated at $S_3$. If the number of sheets in the duplex feed path printed on only one side is less than the Interleave No. and there are no circumstances giving rise to a stop request, as will be described below (Yes), then the print command can be accepted. If not (No), the print engine controller generates a signal to the system controller 184 that it cannot accept more print commands until one or more sheets already in the duplex feed path have been duplex printed on the second side, as indicated at $S_5$. If the print command can be accepted, then the print engine controller 184 determines the appropriate point in time to process the print command, as indicated at $S_6$. If the sheet about to be printed is one of the first few sheets of the document (within the Interleave No.), then enough time must pass from the previous print command so that there is enough space between the consecutive sheets to interleave another sheet therebetween when the sheet about to be printed is later duplex printed. Likewise, the consecutive sheets of paper must be sufficiently spaced apart from one another so that they can be properly fed through the duplex feed path. For example, as described above, the consecutive sheets are ordinarily spaced about 60 millimeters apart so that they can be properly fed through the duplex feed path. Therefore, the print engine controller 184 will delay executing the print command until it is the appropriate time to process that command. When the previously printed sheet is sufficiently spaced downstream and the printing unit 16 is ready to print the images, the print engine controller 184 then generates the signal to feed the sheet of paper from either of the paper cassettes 40 or 42, or the LCIT 22, to print the images on the first side of the sheet, as indicated at $S_7$.

One advantage of the present invention is that the printing apparatus 10 may be employed to consecutively duplex print different sized sheets. After the print command is executed, the print engine controller 184 determines if the paper length has changed recently so as to make the Interleave No. transient, as indicated at $S_8$. If the paper length has changed, then frequently a new transient Interleave No. ($N_t$) has to be set when the new sheet of paper enters the printing unit 16. If the size of the new sheet does cause the Interleave No. to change, then the Interleave No. will be transient as long as the different sized paper sheets remain in the duplex feed path. If, and when the different sized sheets are discharged, and only the same sized sheets remain in the duplex feed path, then the Interleave No. returns to a steady state, until a new different sized sheet that affects the Interleave No. is fed into the apparatus 10. If the print engine controller 184 determines that the paper length has changed (Yes), it then determines if the Interleave No. is still transient, as indicated at $S_9$. If the paper length has not changed (No), then the Interleave No. is not affected and the print command ends. If the Interleave No. is no longer transient (only the same sized sheets remain in the duplex feed path), then the Interleave No. becomes steady state, as indicated at $S_{10}$. The steady state Interleave No. ($N_s$) is then used in implementing the next print command in determining whether the apparatus 10 can accept the print command, as indicated at $S_3$. If the transient state of the Interleave No. has not ended (No) (different sized sheets remain in the duplex feed path), then the print engine controller maintains the Interleave No. in its transient state. The transient state Interleave No. ($N_t$) is then used, like the steady state Interleave No. ($N_s$), in implementing the next print command in determining whether the apparatus can accept the print command, as indicated at $S_3$. The print engine controller 184 usually employs a counter (not shown) to determine if the Interleave No. is transient or steady state. For example, the counter can count the number of print commands that take place after a new sized sheet is fed, and thus determine when only the same sized sheets remain in the duplex feed path.

In FIG. 10B, the procedures for processing a duplex print command generated by the system controller 182 to the print engine controller 184 are shown. When the print engine controller 184 receives a duplex print command, as shown at $S_{11}$, it then determines if the print engine controller 184 is in the duplex printing mode, as shown at $S_{12}$. If not (No), the print engine controller 184 generates a signal that the duplex print command is not valid and cannot be executed, as indicated at $S_{13}$. If the apparatus 10 is in the duplex printing mode (Yes), then the print engine controller 184 determines whether the duplex print command can be accepted, as shown at $S_{14}$. There must be at least one sheet of paper in the duplex feed path that has the images already printed on one side and, therefore, is ready to be duplex printed. If not (No), the print engine controller 184 generates a signal that the duplex print command cannot be executed, as indicated at $S_{15}$. If the apparatus 10 can accept the duplex print command (Yes), then the print engine controller 184 determines the appropriate point in time to execute the duplex print command, as indicated at $S_{16}$. The sheet 44 that was fed through the register rollers 50 under the previous print command, or duplex print command, must be spaced sufficiently downstream, and/or the sheet to be duplex printed must be available in the register rollers 50, before the duplex print command can be executed. When it is the appropriate time to execute the duplex print command, the print engine controller 184 sends a signal to feed the sheet of paper 44 through the register rollers 50 and duplex print the images on its second side, as indicated at $S_{17}$.

Figure 11:
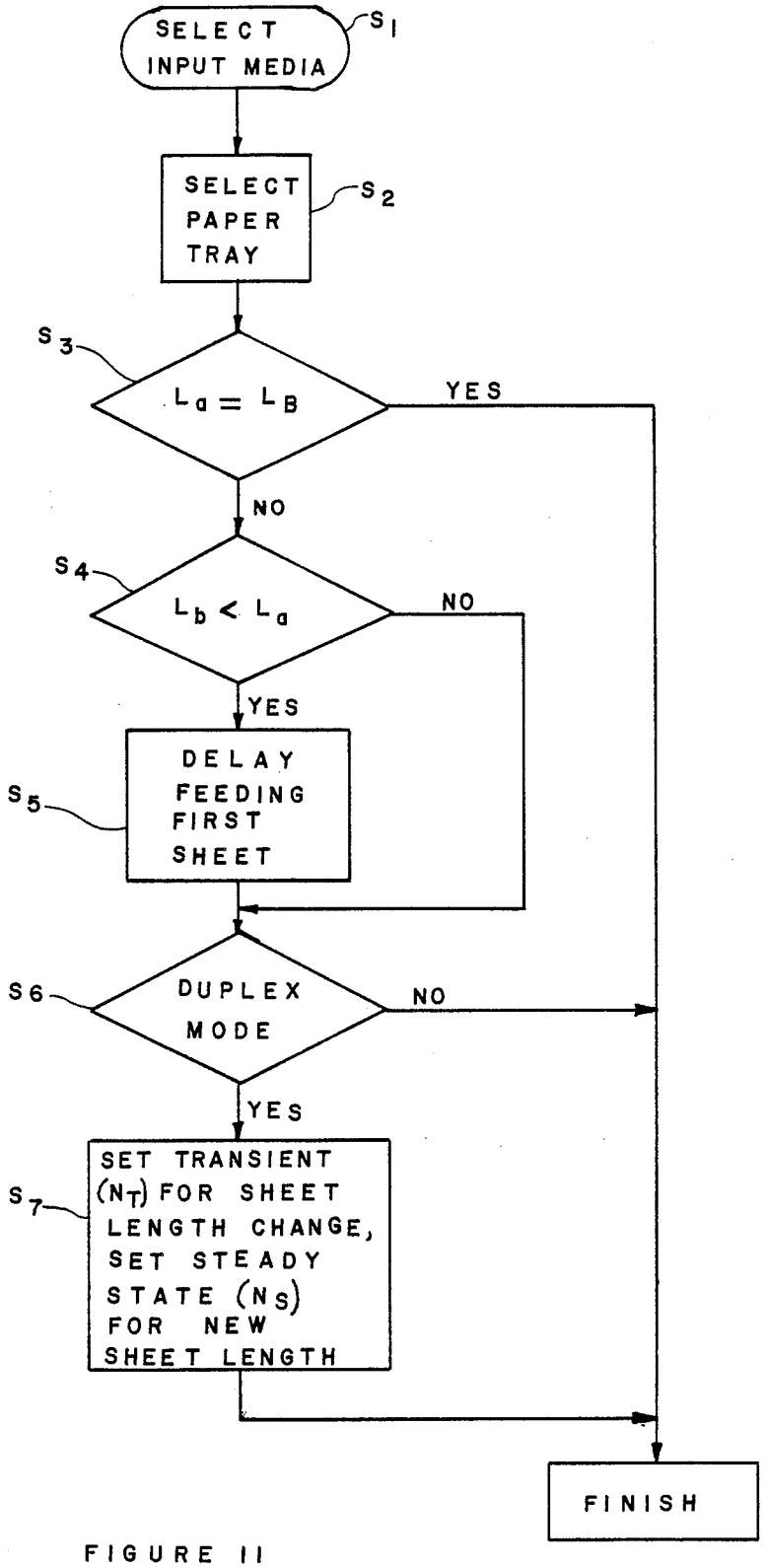
FIG. 11 is a flow chart illustrating conceptually the procedures of the print engine controller of the apparatus of FIG. 1 for executing a select input media command.

Turning to FIG. 11, a flow chart is illustrated that conceptually describes the procedures of the print engine controller 184 when the system controller 182 generates a select input media command, as indicated at $S_1$. A select input media command is usually implemented before a document is to be printed or if a new input media is required, such as a different type of paper or different sized paper sheet. The print engine controller 184 can select different sized sheets of paper (or other input media) by controlling different paper trays. For example, the paper cassette 40 might hold $8\frac{1}{2}\times 11$ inch paper, while the paper cassette 42 might hold $8\frac{1}{2}\times 14$ inch paper. Therefore, depending on the sheet size and, therefore, tray requested by the system controller 182 for the particular print command, the print engine controller 184 pulls the next sheet from the paper tray containing that size of paper, as indicated at $S_2$. If the length of the new sheet of paper ($L_b$) is equal to the length of the previous sheet of paper ($L_a$) (Yes), as indicated at $S_3$, then the select input media command is completed after the paper tray is changed. However, if the length of the new sheet of paper ($L_b$) is less than the length of the previous sheet ($L_a$), then the spacing maintained between those sheets will ordinarily have to be increased over the spacing when the sheets are the same length. When the sheets are reversed in the reversing unit 18, the leading edge of each sheet becomes its trailing edge and vice versa. Therefore, if the spacing is not increased, when a subsequent shorter sheet is reversed it usually will overlap a previous longer sheet in either the reversing unit 18 or duplexing unit 14. So, if the length of the new sheet ($L_b$) is less than the length of the previous sheet (Yes), as shown at $S_4$, the print engine controller 184 appropriately delays feeding the new sheet in order to maintain a sufficient amount of space between the sheets so they do not overlap when reversed, as indicated at $S_5$. If the length of the new sheet $L_b$) is longer than the previous sheet ($L_a$) (NO), then there is no concern for overlap and, therefore, the spacing between the sheets does not have to be adjusted.

After the print engine controller 184 delays feeding the shorter subsequent sheet, or after it determines that the new sheet is longer then the previous sheet and does not delay feeding the new sheet, it then determines whether the print engine controller 184 is in the duplex mode, as shown at $S_6$. If so (Yes), then the print engine controller 184 determines both the transient Interleave No. ($N_t$) and the steady state Interleave No. ($N_s$), according to the length of the new sheet ($L_b$), as indicated at $S_7$. The transient Interleave No. ($N_t$) is set low enough to handle the sheet length transition, or, that is, to accommodate the different sized sheets in the duplex feed path. For example, if the transient Interleave No. is calculated to include a fraction, then the print engine controller will truncate the Interleave No. to the next lowest integer. The transient Interleave No. is then used by the print engine controller 184 when executing the next print command for determining if the apparatus can accept the print command, as indicated at $S_3$ in FIG. 10A. The steady state Interleave No. ($N_s$), on the other hand, is set to be employed if, and when all the sheets in the duplex feed path are the same size as the new sheet.

Figure 12:
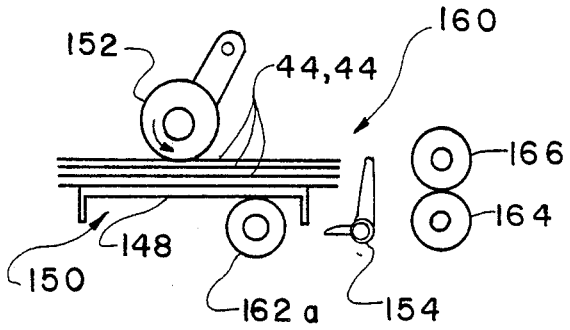
FIG. 12 is a schematic illustration of another embodiment of the jogger unit of the apparatus of FIG. 1.
Figure 13:
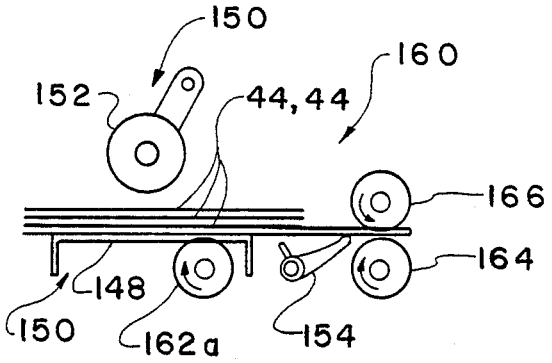
FIG. 13 is another schematic illustration of the jogger unit of FIG. 13 shown feeding the sheets of paper stacked in the jogger unit.

Turning to FIGS. 12 and 13, another embodiment of the jogger unit 150 and refeeding unit 160 is shown. Here, the jogger unit 150 is adapted to temporarily stack the sheets of paper 44,44 therein in the event that there is a signal delay, such as an image processing or image transfer delay, as will be described in further detail below. After the printing apparatus 10 recovers from the delay and the printing unit 16 is ready to resume printing, the refeeding unit 160 feeds the paper sheets in the same order that they were fed into the jogger unit 150, back through the printing unit 16. Therefore, the jogger unit 150 can stack the sheets of paper in a first-in-first-out (FIFO) manner, as opposed to the known stack method of duplex recording that stacks the sheets in a last-in-first-out (LIFO) manner. Therefore, if it is necessary to stack the sheets in the intermediate paper tray, the FIFO manner of stacking of the present invention will ordinarily achieve a faster duplex printing rate, than if a LIFO manner of stacking were employed.

As shown in FIGS. 12 and 13, the jogger unit 150 and refeeding unit 160 are substantially the same as described above in relation to the previous embodiment, except that the pick-up roller, indicated as **162*a*, is not located above the stopping members 154, but is located in the bottom of the jogger unit 150. Additionally, the separator roller 166 is mounted above the feeding roller 164, and not below the feeding roller as described above in relation to the previous embodiment. Therefore, in the operation of the jogger unit, when there is a signal delay, the sheets of paper 44,44 can be temporarily stacked on top of one another with their leading edges against the stopping members 154,154, as shown in FIG. 12. The jogger feed roller 152 consecutively feeds the paper sheets 44,44 on top of one another into the jogger unit during the signal delay, as indicated by the arrow in FIG. 12. Then, when the printing apparatus recovers from the delay, the stopping members 154,154 are released downwardly, as shown in FIG. 13, and the pick-up roller 162*a* is rotated to consecutively discharge each bottom sheet 44 from the stack. If the pick-up roller 162*a* pulls more than one sheet from the stack, the separator roller 166 will prevent the top sheet from passing between the rollers. The sheets are then consecutively fed back through the printing unit 16** in the same manner as described above in relation to the previous embodiment.

The printing apparatus 10 further comprises one or more electromagnetic clutches (not shown) which are each coupled respectively to the driving motors (not shown) of the rollers throughout the apparatus, in a manner known to those skilled in the art. The printing apparatus 10 also comprises several sensors (not shown), of a type known to those skilled in the art, that are mounted in spaced locations on the paper path throughout the apparatus 10. For example, sensors are located at the register rollers 50, the jogger unit 150, the releasing gate 138, and the discharge rollers 102, for determining if a sheet of paper is located in those respective locations. The sensors are each electrically coupled to their respective modular control units (not shown) and, in turn, to the print engine controller 184. Therefore, the print engine controller 184 can monitor the location of each sheet of paper 44,44 in the duplex feed path based on the signals generated by each of the respective sensors.

The printing apparatus 10 of the present invention is preferably controllable so that it distinguishes between three types of stop requests: an emergency stop request, a graceful stop request, and a non-emergency stop request. If there is an emergency stop request, the drive motors (not shown) for the feeding rollers in at least the modular unit where the circumstances giving rise to the stop request occur, are immediately stopped to stop the paper sheets 44,44 in the feed path. If there is a graceful stop request, the sheets are not immediately stopped, but are moved to certain desired locations before the rollers are stopped, to treat the problem that gave rise to the stop request. If there is a non-emergency stop request, the apparatus 10 continues to print the paper sheets 44,44 that are already in the duplex feed path, but does not feed any new sheets into the printing unit. Then, after all of the existing sheets are discharged from the apparatus, the apparatus is stopped and the problem giving rise to the non-emergency stop request is treated.

An emergency stop request may be caused, for example, by one of the following problems that might ordinarily be encountered in laser printing and other image recording apparatus: abnormal laser operation, a polygon motor malfunction, abnormal synchronization detection, an abnormality in a paper feed path, such as a paper jam, an unusual temperature rise, or an unusual temperature drop in one of the image formation or image transfer components, a short circuit, a malfunction in a driving motor for one or more of the feed rollers, and other such problems that can cause a printing malfunction or error. A non-emergency stop request might be caused, for example, by an operator's request to replenish a low toner supply, a low fuser-oil supply, or a low paper supply.

A graceful stop request, on the other hand, is executed, for example, when there is an image processing delay in the system controller 182. There are certain locations in the printing apparatus 10 that are not desirable for stopping the sheets of paper, such as the image fusing unit 38, because it might burn the paper if the paper is left there too long. Likewise, in other sections of the duplex feed path where there are curves or sharp corners, if the paper is stopped there for a long enough period of time, depending on the temperature, humidity and/or type of paper, the paper might curl and then jam the duplex feed path. Depending on the particular configuration of the printing apparatus, and depending on the length of the paper sheets, there are certain desired locations for temporarily stopping the sheets in the event of an image processing delay. Therefore, in the printing apparatus 10, when the sheets of paper are stopped pursuant to a graceful stop request, the sheets are preferably stopped in the following three graceful stop locations: the intermediate paper tray 148, the register rollers 50, and inside the releasing gate 138. If the paper sheets are temporarily stopped in the three graceful stop locations, the sheets ordinarily will not develop curls or bends that would later cause the sheet to jam the feed path, before the sheets are duplex printed. It should be noted, however, that if the printing apparatus 10 incorporates the embodiment of the jogger unit 150 and refeeding unit 160, as shown in FIGS. 12 and 13, in the event of a graceful stop request, the sheets can be temporarily stacked in the jogger unit 150, as described above, instead of being stopped in the three separate graceful stop locations.

Figure 14:
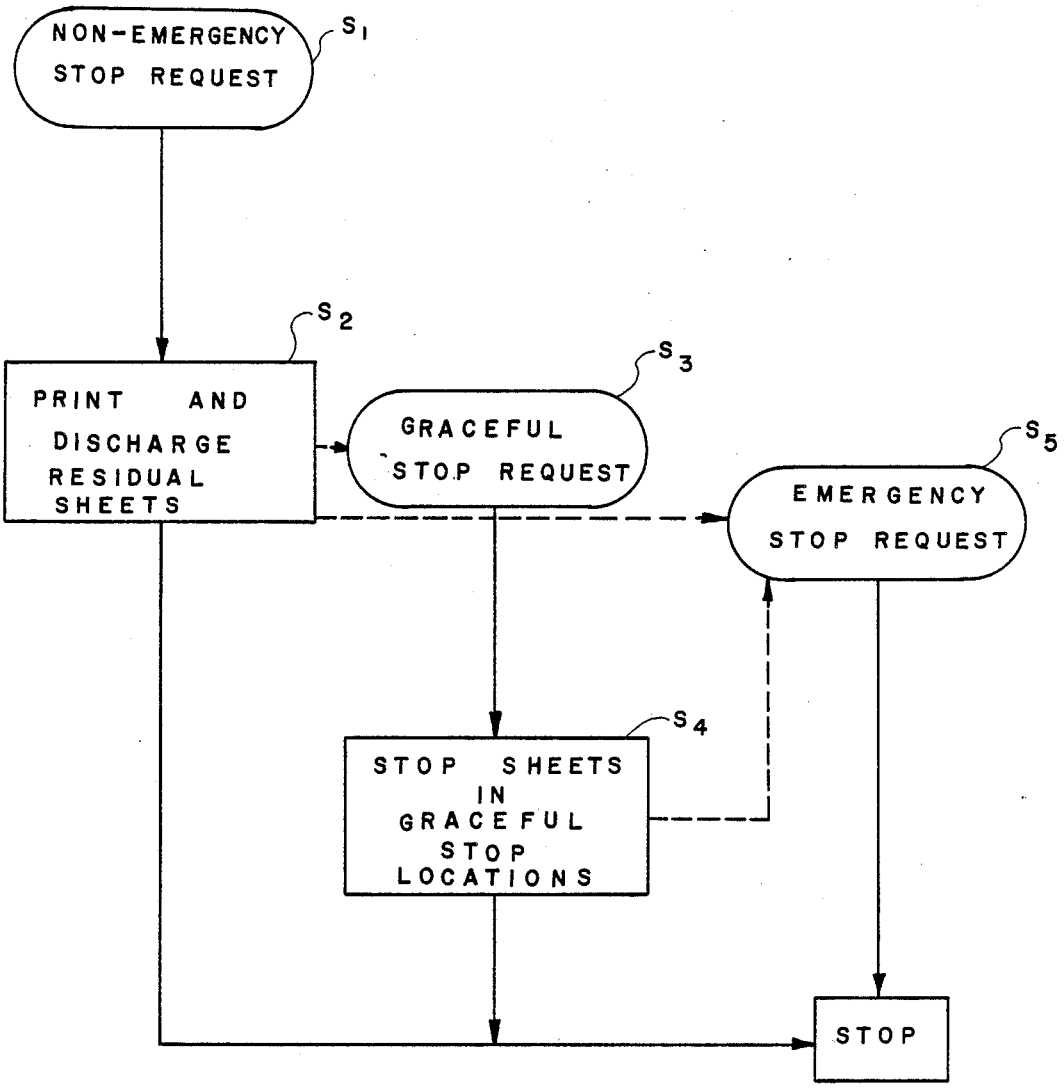
FIG. 14 is a flow chart illustrating conceptually the procedures of the print engine controller of the apparatus of FIG. 1 for executing non-emergency, graceful and emergency stop requests.

Turning to FIG. 14, a flow chart is illustrated that conceptually describes the procedures for operating the print engine controller 184, in accordance with the method of the present invention of distinguishing between emergency stop requests, graceful stop requests, and non-emergency stop requests When the print engine controller 184 receives a non-emergency stop request from the system controller 182, as indicated at $S_1$, the print engine controller 184 continues to control the printing and discharging of the sheets already in the duplex feed path, but does not feed any new sheets into the printing unit 16, as indicated at $S_2$. When all of the residual sheets in the duplex feed path are either simplex or duplex printed and discharged, then the print engine controller 184 executes the stop request. If, however, during execution of the non-emergency stop request a condition gives rise to a graceful stop request or emergency stop request, then the print engine controller 184 immediately executes either of those requests, as indicated by the dotted lines in FIG. 14. If the print engine controller 184 generates a graceful stop request, as indicated at $S_3$, then the print engine controller first controls the movement of the sheets (as indicated by the sensors in the duplex feed path) until they each respectively reach the graceful stop locations, and then executes the stop request, as shown at $S_4$. Therefore, one sheet is stopped in the register rollers 50, one sheet is stopped in the releasing gate 138, and another sheet is stopped in the intermediate paper tray 148. However, as mentioned above, if the apparatus 10 comprises the jogger unit 150 as illustrated in FIGS. 12 and 13, then all of the sheets in the duplex feed path can be temporarily stacked in the jogger unit in a FIFO manner, rather than in the graceful stop locations.

If an emergency stop request is generated during implementation of the graceful stop request, then the print engine controller executes the emergency stop request, as indicated by the dotted line in FIG. 14. Finally, if the system generates an emergency stop request, as indicated at $S_5$, the print engine controller 184 executes the stop in at least the modular unit where the circumstances giving rise to the stop request occur.

It should be noted that if the printing apparatus has, for example, only three graceful stop locations for a graceful stop request (in the printing apparatus 10 the three stop locations are the register rollers 50, the releasing gate 138, and the intermediate paper tray 148, as described above) then no more than three sheets that are printed on only one side should be maintained in the duplex feed path at any one time in order to implement a graceful stop request. However, if the Interleave No. is four (4) or greater, then in order to achieve the maximum printing rate it is usually necessary to maintain at least four sheets in the duplex feed path. The method and apparatus of the present invention overcomes this problem by operating in accordance with a continuous duplex printing mode.

Pursuant to the continuous duplex printing mode, the number of sheets that equals the Interleave No. can be maintained in the duplex feed path (even if the number is greater than the number of graceful stop locations), and a graceful stop request can still be implemented, while achieving the maximum printing rate of the apparatus. The system controller 182 processes the images to be printed by employing a page description language, of a type known in the art, that generates a linear description of the document to be printed. The system controller 182 then employs an interpreter, also known in the art, that interprets the page description language into display lists for each page of the document. The display lists are low level page descriptions that are stored in computer memory. The system controller 182 further comprises four bit maps, wherein each bit map corresponds to a page of the document to be printed. Therefore, when the system controller processes the image information for each page, it transfers the display list for each page into one of the four bit maps. Then, when the bit map is formed for the respective page, the print command for that page can be executed by the print engine controller 184.

In the continuous duplex printing mode, the print engine controller 184 executes a paired print command ("PD") pursuant to which the bit maps for two consecutive pages are first formed and are both then executed by the same command of the print engine controller 184. The first part of the command (PD) is to print the first side of the first side, and the second part is to duplex print the second side of the second sheet. Therefore, if a graceful stop request occurs during the paired print command (PD), the second sheet that is duplex printed pursuant to that command is duplex printed and discharged from the printing apparatus, leaving only three sheets (or as many sheets as there are graceful stop locations) in the duplex feed path. Therefore, the remaining sheets can then be stopped at the three respective graceful stop locations.

The continuous printing mode of the present invention will be hereinafter further described in accordance with the following example illustrated in the chart below.

| | | | | | | | | | | | | | |
|---|---|---|---|---|---|---|---|---|---|---|---|---|---|
| (1) Document Pages | 1 | 2 | 3 | 4 | 5 | 6 | 7 | 1 | 8 | 9 | 3 | 10 | |
| (2) Display Lists | x | x | x | x | x | x | x | | x | x | | x | |
| (3) Bit Map Formation | | x | | x | | x | | x | x | | x | x | |
| (4) Sheets Printed | | | 1a | | 2a | | | 3a | | 4a | 1b | | 5a 2b |
| (5) Commands | I | F,P | | | F,P | | F,P | | F,PD | | | F,PD | |

The rows (1) through (5) of the chart illustrate the image processing procedures of the system controller 182 and print engine controller 184 in relative chronological order. Row one (1) indicates the linear description of the pages of the document to be printed generated by the system controller 182. The second row (2) indicates when the respective page of document description is computed into a display list and stored in memory. The third row (3) indicates relatively about when the respective page display list is computed into one of the four bit maps of the system controller 182.

The fourth row (4) indicates the paper sheet and its side that is printed. For example, (1*a*) indicates that the first side of the first sheet is printed, whereas (1*b*) indicates that the second side of the first sheet is printed. Row five (5) indicates the commands executed by the print engine controller 184 to print the side of the respective sheet of paper. The commands are defined as follows:

P is a print command as illustrated in the flow chart of FIG. 10A;

F is a feed command which is implemented to feed a sheet of paper from one of the respective paper trays (the paper cassettes 40 or 42, or LCIT 22);

I is a select input media command as illustrated by the flow chart in FIG. 11;

D is a duplex print command as illustrated in FIG. 10B; and

PD is a paired print command which executes consecutively a print command (P) and duplex print command (D) on two successive sheets of paper.

As shown in the chart above, after the display list for page 2 is computed and the bit map is formed, the print engine controller 184 generates a feed command (F) and a print command (P) to print page 2 on the first side of sheet one (1a). Then, after the bit map is formed for page 4, the print engine controller 184 again generates a feed command (F) and print command (P) to print page 4 on the first side of sheet two (2a). Then, after the bit map is formed for page 6, the print engine controller 184 again generates a feed command (F) and print command (P) to print page 6 on the first side of sheet three (3a). After sheet three (3a) is printed there are then three sheets in the duplex feed path that are printed on only one side. Therefore, in order to accommodate a graceful stop request, if it occurs, a paired print command (PD) is employed. Pursuant to the paired print command (PD), the first sheet (1) is held in the jogger unit 150 (if necessary) until the bit maps are formed for page one (1) and page eight (8). Then, after both bit maps are formed, the print engine controller 184 executes the feed command (F) and paired print commands (PD). The fourth sheet is then fed into the printing unit 16 and page 8 is printed on its first side (4a). Then, as part of the same command (PD), the first sheet is then fed from the jogger unit 150 and page one (1) is printed on its second side (1b). Therefore, if prior to executing the paired print command (PD) circumstances give rise to a graceful stop request, there are only three sheets in the duplex feed path and the graceful stop request can be executed. Then, if after generating the paired print command (PD) a graceful stop request has to be executed, the first sheet one (1) is duplex printed by the PD command and can then be discharged from the apparatus. Therefore, the other three sheets remaining in the duplex feed path (sheets 2, 3 and 4) can then be stopped in the graceful stop locations. Therefore, by operating in the continuous duplex printing mode with the paired print commands (PD), the apparatus 10 can operate with the Interleave No. of sheets in the duplex feed path, yet still perform a graceful stop request when required.

Another feature of the apparatus and method of the present invention is that a user can begin printing one document or job unit in the printing apparatus 10, before the last sheets of the previous document are discharged from the apparatus. Likewise, the two successive documents do not have to be printed on the same type of paper, but can be printed on different sized paper sheets.

Figure 15:
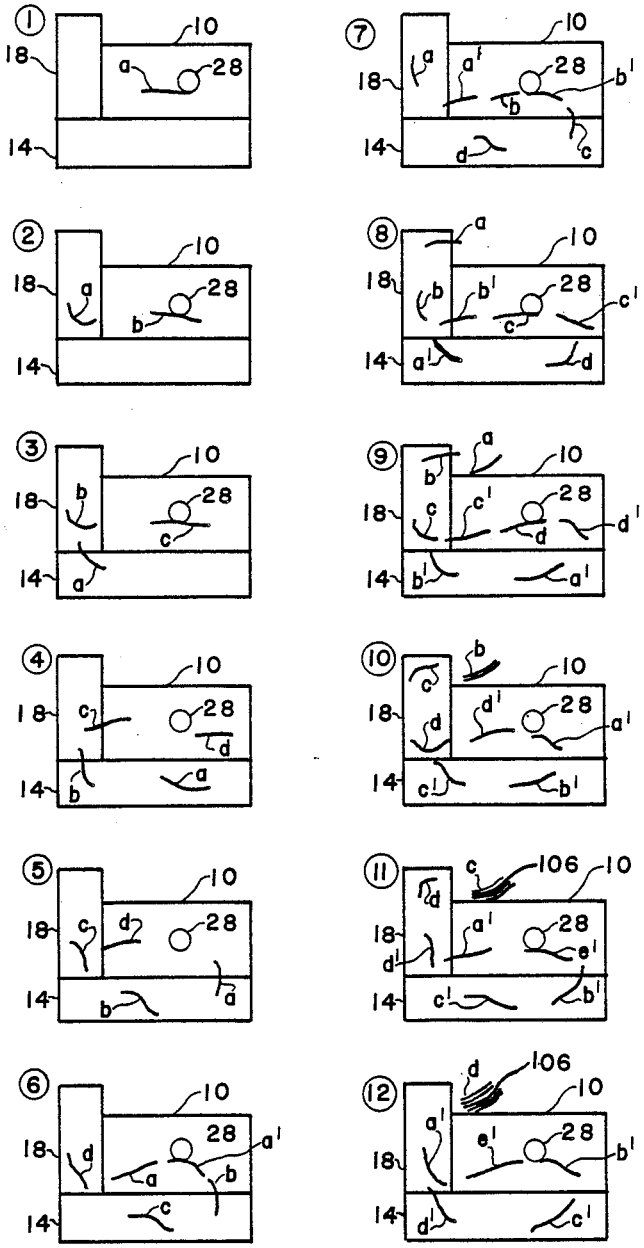
FIG. 15 illustrates schematically the successive stages of interleaving the pages of a second document among the pages of a first document in accordance with the method of the present invention.
Figure 9:
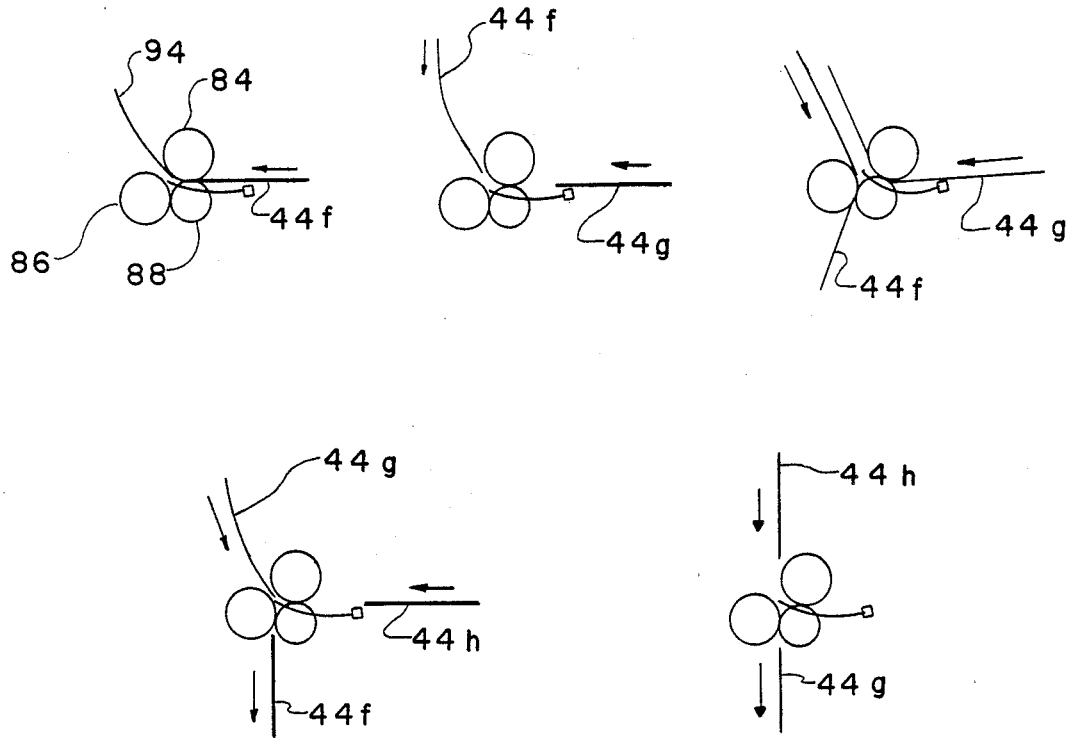
FIG. 9 is a schematic illustration of part of the reversing unit of FIG. 4 showing the successive stages of reversing the sheets of paper in accordance with the method of the present invention.

In FIG. 15, an example of the method of the present invention of interleaving a second document for duplex printing, before the last paper sheets of a previous duplex printed document are discharged from the apparatus 10, is illustrated schematically. The first document to be duplex printed comprises eight pages and, therefore, requires four paper sheets, illustrated schematically as (a), (b), (c) and (d). The second document to be printed includes five sheets, (a') through (e'). The two columns of FIG. 15 include sketches (1) through (12), that illustrate the sequential steps for duplex printing the paper sheets of the first document, (a) through (d), and the paper sheets of the second document, (a') through (e'). As shown in sketch (12), for example, after each sheet is duplex printed, they are consecutively stacked on top of one another in the paper tray 106.

The second document is interleaved between the sheets of the first document as illustrated in sketch (6). After the sheet (a) of the first document is duplex printed, the first sheet (a') of the second document is then interleaved between the sheets (a) and (b) of the first document. Then, the subsequent sheets of the second document are interleaved between the sheets of the first document, as shown in sketches (7) through (9). The last sheet (e') of the second document is then interleaved between sheets (a') and (b') of that document, as shown in sketch (11). Therefore, the duplex feed path does not have to be cleared of the sheets of the previous document before the subsequent document is printed. As a result, by employing the interleave method of the present invention, a substantial increase in the overall printing rate when duplex printing two or more consecutive documents, should be achieved.

What is claimed is:

1. An apparatus for duplex recording images on several sheets of material, said apparatus comprising:

an image recording unit for recording images consecutively on the first sides of the sheets of material and on the second sides of the sheets of material;

a reversing unit mounted adjacent to said image recording unit for receiving the sheets of material discharged from said image recording unit and for consecutively reversing the sheets and/or discharging the sheets therefrom;

a duplexing unit mounted adjacent to said reversing unit and said image recording unit for receiving the reversed sheets of material discharged from said reversing unit and for consecutively feeding the reversed sheets back into said image recording unit for recording images on the second sides of the sheets, said image recording unit, said reversing unit and said duplexing unit thus defining a duplex feed path for carrying the sheets of material for duplex recording; and control means coupled to said image recording unit, said reversing unit, and said duplexing unit for controlling the same, said control means being provided for determining an interleave number that is equal to the maximum number of sheets of material with images recorded on only the first sides thereof that can fit within said duplex feed path so that each consecutive sheet is spaced a sufficient distance apart to interleave a new sheet therebetween, said control means being operable to control said units so that after the number of sheets spaced apart in said duplex feed path with the images recorded on only their first sides is equal to or less than the interleave number, the new sheets are consecutively interleaved therebetween so that the new sheets are recorded on their first sides alternately with the reversed sheets that are duplex recorded on their second sides.

2. A method for duplex recording images on several sheets of material in a duplex recording apparatus, said method comprising the following steps:

(a) determining an interleave number that is equal to the maximum number of sheets of material with images recorded on only the first sides thereof that fits within the duplex feed path of the apparatus, so that each consecutive sheet is spaced a sufficient distance apart to interleave a new sheet therebetween;

(b) consecutively recording the images on the first sides of a number of sheets of material equal to or less than the interleave number, the sheets being fed through an image recording unit one after the other and spaced a sufficient distance apart to interleave new sheets therebetween; and (c) after a number of sheets that is equal to or less than the interleave number have the images recorded on their first sides, feeding or interleaving new sheets therebetween, so that the images are recorded on the first sides of the new sheets alternately with the images that are duplex recorded on the second sides of the other sheets.

3. A method for duplex recording images on several sheets of material in a duplex recording apparatus, at least one of the sheets being a different size than at least one of the others, said method comprising the following steps:

determining an interleave number that is equal to the maximum number of sheets of material with images recorded on only the first sides thereof that can fit within the duplex feed path of the apparatus, so that each consecutive sheet is spaced a sufficient distance apart to interleave a new sheet therebetween, said interleave number being based on the size of the first sheet to have the images recorded thereon;

consecutively recording the images on the first sides of a number of sheets of material equal to or less than the interleave number, the sheets being spaced a sufficient distance apart to interleave new sheets therebetween; and changing the interleave number to a transient interleave number if a different sized sheet than the previous sheet is fed into the duplex feed path, said transient interleave number being based on the lengths of the new sheet and the other sheets in the duplex feed path.

4. A method for duplex recording images on several sheets of material, at least one of the sheets being a different size than at least one of the others, as described in claim 3, said method further comprising the following steps:

selecting a new input media when a different sized sheet is required, and if the new sheet is shorter than the previous sheet, delaying feeding the new sheet into the duplex feed path so that the two sheets are spaced a sufficient distance apart, such that when the new sheet is reversed it will not overlap the previous sheet.

5. A method for duplex recording images on several sheets of paper, at least one of the sheets being a different size than at least one of the others, as described in claim 3, said method further comprising the following steps:

after determining the transient interleave number, determining whether the next sheet to be recorded on its first side can be recorded and fed into the duplex feed path, without the number of sheets in the duplex feed path with the images recorded on their first sides exceeding the transient interleave number.

6. A method for duplex recording images on several sheets of material as described in claim 2, said method further comprising the following steps:

stopping the sheets in the duplex feed path in the event of an image processing delay, by first moving each sheet to a different desired stopping location so that the sheet will likely not develop a curl and/or bend if temporarily stopped that will cause the sheet to jam a feed path, and then continuing to move the sheets through the duplex feed path as the recording apparatus recovers from the delay.

7. A method for duplex recording images on several sheets of material as described in claim 6, said method further comprising the following steps:

if the interleave number is one integer greater than the number of desired stopping locations, the image information for the first side of the next sheet that will make the number of sheets in the duplex feed path equal the interleave number is processed, and then the image information for the next sheet to be duplex recorded is processed prior to recording the images on the first side of the previous sheet, so that if an image processing delay occurs while recording on the first sheet, the images can then be duplex recorded on the second sheet, and the duplex recorded sheet then can be discharged from the apparatus while the other sheets recorded on only their first sides are moved to the respective stopping locations.

8. An apparatus for duplex recording as defined in claim 1, wherein said reversing unit comprises:

at least one driving roller rotatably mounted within said reversing unit;

at least one first switching roller rotatably mounted above said driving roller in contact therewith;

at least one second switching roller rotatably mounted in contact with said driving roller and spaced apart from said first switching roller; and a motor coupled to said driving roller, said motor also being coupled to said control means for rotatably driving said driving roller and, in turn, rotatably driving said first and said second switching rollers for reversing sheets of material, wherein the sheets are first fed between said driving roller and said first switching roller, and then the trailing edges of the sheets are first fed between said driving roller and said second switching roller for reversing and discharging the sheets.

9. An apparatus for duplex recording as described in claim 8, wherein said control means is operable to control said reversing unit so that one sheet is fed into said reversing unit between said driving roller and said first switching roller, while another reversed sheet is simultaneously discharged from said reversing unit between said driving roller and said second switching roller.

10. An apparatus for duplex recording images on several sheets of material as defined in claim 1, wherein said duplexing unit comprises:

an intermediate paper tray mounted therein for receiving reversed sheets of paper discharged from said reversing unit; and a jogger unit mounted on the exit side of said intermediate paper tray, for receiving at least the leading edges of the reversed sheets of paper fed into said intermediate paper tray, said jogger unit further comprising at least one pick-up roller rotatably mounted therein for discharging the sheets in said jogger unit one at a time in a first-in-first-out manner, for feeding the reversed sheets back through said image recording unit.

11. An apparatus for duplex recording images on several sheets of material as defined in claim 10, wherein said pick-up roller is mounted in the bottom of said jogger unit, so that the sheets fed into said jogger unit are located on top of said pick-up roller, such that if several sheets are stacked within said jogger unit, said pick-up roller discharges the sheets one at a time from the bottom of the stack in a first-in-first-out manner, for feeding the reversed sheets one at a time back through said image recording unit.

12. An apparatus for duplex recording as described in claim 11, wherein said control means is operatively coupled to said pick-up roller, so that if there is an image processing delay, said control means operates said printing unit, said reversing unit, and said duplexing unit to move each sheet recorded on only one side into said jogger unit on top of one another, then, when the delay is over, said pick-up roller discharges the sheets one at a time from the bottom of the sheets in a first-in-first-out manner from the jogger unit and back through said image recording unit.

13. An apparatus for duplex recording as defined in claim 1, wherein said control means is operable so that if there is an image processing delay, said control means operates said printing unit, said reversing unit and said duplexing unit to move each sheet located in said duplex feed path to a respective desired stopping location within said duplex feed path, each of said stopping locations being selected so that the sheets will likely not develop curls and/or bends that might jam the duplex feed path, for temporarily stopping the sheets until the delay is over.

14. An apparatus for duplex recording as defined in claim 13, wherein said control means is operable so that if the interleave number is one integer greater than the number of desired stopping locations, said control means processes the image information for the first side of the next sheet that will make the number of sheets in the duplex feed path equal the interleave number, said control mean is operable to then process the image information for the next sheet to be duplex recorded prior to recording the images on the first side of the previous sheet, such that if an image processing delay occurs while recording on the first sheet, said control means operates said image recording unit to duplex record the images on the second sheet, and the duplex recorded sheet is then discharged from said apparatus while the other sheets recorded on only their first sides are moved to the respective stopping locations.

* * * * *